US011548757B2

(12) United States Patent
Takezawa et al.

(10) Patent No.: US 11,548,757 B2
(45) Date of Patent: Jan. 10, 2023

(54) IMAGE FORMING APPARATUS

(71) Applicant: CANON KABUSHIKI KAISHA, Tokyo (JP)

(72) Inventors: Hiroaki Takezawa, Tsukubamirai (JP); Atsushi Yoshida, Abiko (JP); Hiroshi Kokubo, Tokyo (JP); Noriaki Koyanagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 16/921,978

(22) Filed: Jul. 7, 2020

(65) Prior Publication Data

US 2021/0009376 A1 Jan. 14, 2021

(30) Foreign Application Priority Data

Jul. 12, 2019 (JP) ..... JP2019-130430
Mar. 24, 2020 (JP) ..... JP2020-052460

(51) Int. Cl.

| | |
|---|---|
| ***B65H 85/00*** | (2006.01) |
| ***G03G 15/00*** | (2006.01) |
| ***B65H 29/58*** | (2006.01) |
| ***G03G 15/23*** | (2006.01) |
| ***B65H 5/38*** | (2006.01) |

(52) U.S. Cl.

CPC ..... *B65H 85/00* (2013.01); *B65H 5/38* (2013.01); *B65H 29/58* (2013.01); *G03G 15/234* (2013.01); *G03G 15/6555* (2013.01); *B65H 2301/33312* (2013.01); *B65H 2402/441* (2013.01);

(Continued)

(58) Field of Classification Search

CPC . B65H 5/06; B65H 5/062; B65H 5/36; B65H 5/38; B65H 85/00; B65H 2301/333; B65H 2301/3331; B65H 2301/33312; B65H 2301/31122; B65H 2301/31124; B65H 2301/3122; B65H 2402/31; B65H 2402/441; B65H 2402/45; B65H 2404/611; B65H 2404/7431; G03G 15/234; G03G 2215/00438

See application file for complete search history.

(56) References Cited

U.S. PATENT DOCUMENTS 4,878,656 A 11/1989 Honjo et al.
5,018,716 A 5/1991 Yoshida et al.

(Continued)

FOREIGN PATENT DOCUMENTS

JP 2000-247525 A 9/2000

*Primary Examiner* — Prasad V Gokhale
(74) *Attorney, Agent, or Firm* — Venable LLP

(57) ABSTRACT

An image forming apparatus includes an image forming portion, a reversing portion configured to reverse the sheet received through a first feeding passage by feeding the sheet in a first direction and then in a second direction opposite to the first direction, a sheet feeding portion provided in a second feeding passage branching from the first feeding passage on a side upstream of the reversing portion with respect to the first direction, a first guiding surface forming the second feeding passage for guiding a first surface of the sheet fed by the feeding portion, and a second guiding surface for guiding a second surface, opposite from the first surface, of the sheet fed from the reversing portion in the second direction. The second guiding surface is movable with movement of the first guiding surface for opening the second feeding passage.

12 Claims, 14 Drawing Sheets

(52) U.S. Cl.
CPC ..... *B65H 2404/611* (2013.01); *B65H 2404/7431* (2013.01); *G03G 2215/00438* (2013.01)

(56) References Cited

U.S. PATENT DOCUMENTS

| | | | | |
|---|---|---|---|---|
| 5,105,225 | A | 4/1992 | Honjo et al. | |
| 5,305,995 | A | 4/1994 | Nakajima et al. | |
| 5,351,112 | A | 9/1994 | Naito et al. | |
| 5,442,431 | A | 8/1995 | Fujimoto et al. | |
| 5,579,083 | A | 11/1996 | Naito et al. | |
| 5,671,917 | A | 9/1997 | Choho et al. | |
| 5,819,151 | A | 10/1998 | Naito et al. | |
| 6,021,305 | A | 2/2000 | Sato et al. | |
| 6,098,977 | A | 8/2000 | Sato et al. | |
| 7,883,087 | B2 * | 2/2011 | Kitano | B65H 43/04 271/259 |
| 9,096,409 | B2 | 8/2015 | Koyanagi | |
| 10,152,012 | B2 | 12/2018 | Yoshida et al. | |
| 10,280,020 | B2 | 5/2019 | Yoshida | |
| 10,289,054 | B2 | 5/2019 | Koyanagi | |
| 10,577,205 | B2 | 3/2020 | Kokubo | |
| 10,754,279 | B2 | 8/2020 | Kokubo | |
| 2002/0074720 | A1 * | 6/2002 | Kato | B41J 11/006 271/264 |
| 2012/0228816 | A1 * | 9/2012 | Tomatsu | G03G 21/1638 271/3.19 |
| 2015/0069698 | A1 * | 3/2015 | Sugiura | B41J 3/60 271/147 |
| 2018/0305152 | A1 * | 10/2018 | Sakurai | B65H 5/062 |
| 2018/0348691 | A1 | 12/2018 | Koyanagi | |

* cited by examiner

IMAGE FORMING APPARATUS

FIELD OF THE INVENTION AND RELATED ART

The present invention relates to an image forming apparatus for forming an image on a sheet.

The image forming apparatus such as a printer, a copying machine or a multi-function machine is provided with a reverse feeding mechanism for charging a front side and a back-side of a sheet as a recording material depending on a purpose such as double-side printing or a face-down discharge. The reverse feeding mechanism executes an operation in which in order to change the front side and the back-side of the sheet, a leading end and a trailing end of the sheet fed are changed by reversing the sheet. This operation is called switch-back feeding of the sheet in general, and the switch-back feeding is carried out by a reversing roller pair for reversing and feeding the sheet.

In the case where the double-side printing is executed, the sheet subjected to the switch-back feeding by the reversing roller pair is fed to a re-feeding passage for the double-side printing. Then, the sheet is fed again to the image forming portion in a state in which a first surface of the sheet on which an image has already been formed and a second surface which is opposite from the first surface and on which an image is formed.

In the re-feeding passage including the reverse feeding mechanism, in the case where a jam of the sheet occurs, there is a need to perform removal of a jammed sheet by opening the feeding passage through movement of a part of a member constituting the feeding passage. Japanese Laid-Open Patent Application 2000-247525 discloses a technique such that falling of the jammed sheet is prevented by a constitution in which a slidable piece projects toward a vertical feeding passage with an operation of opening a guiding wall constituting the vertical feeding passage for reverse feeding.

Incidentally, in recent years, a demand for an image forming apparatus for forming images on a wide variety of sheets increases, so that it has been required that a sheet (for example, a long (elongated) sheet) longer in sheet length with respect to a sheet feeding direction than a regular-size sheet with a general length is fed.

Here, when the reversing roller pair carried out the switch-back feeding of the sheet, the sheet is fed to a predetermined position in a state in which the sheet received from an upstream feeding passage with respect to the sheet feeding direction by the reversing roller pair is nipped between the reversing roller pair, and thereafter, rotation of the reversing roller pair is reversed and then the sheet is fed to the re-feeding passage. For this reason, for example, in order to subject the long sheet to the switch-back feeding, there is a need to ensure a space in which a part of the sheet fed from the reversing roller pair is temporarily retracted. However, in a constitution in which the long sheet is subjected to the switch-back feeding and then is fed to the re-feeding passage, operativity for removing the jammed sheet has not been considered.

SUMMARY OF THE INVENTION

A principal object of the present invention is to provide an image forming apparatus capable of improving operativity for removing a jammed sheet while reversing and feeding a long sheet (continuous sheet).

According to an aspect of the present invention, there is provided an image forming apparatus comprising: an image forming portion configured to form an image on a sheet; a reversing portion configured to reverse the sheet, on which the image is formed by the image forming portion and which is received through a first feeding passage, by feeding the sheet in a first direction and then by feeding the sheet in a second direction opposite to the first direction; a feeding portion provided in a second feeding passage branching from the first feeding passage on a side upstream of the reversing portion with respect to the first direction and configured to feed the sheet, reversed by the reversing portion, toward the image forming portion through the second feeding passage; a first guiding surface forming the second feeding passage and configured to guide a first surface of the sheet fed by the feeding portion; and a second guiding surface configured to guide a second surface, opposite from the first surface, of the sheet fed from the reversing portion in the second direction, wherein the second guiding surface is movable with movement of the first guiding surface for opening the second feeding passage.

As a result, it becomes possible to improve the operativity for removing the jammed sheet while reversing and feeding the long sheet.

Further features of the present invention will become apparent from the following description of exemplary embodiments with reference to the attached drawings.

Figure 14:
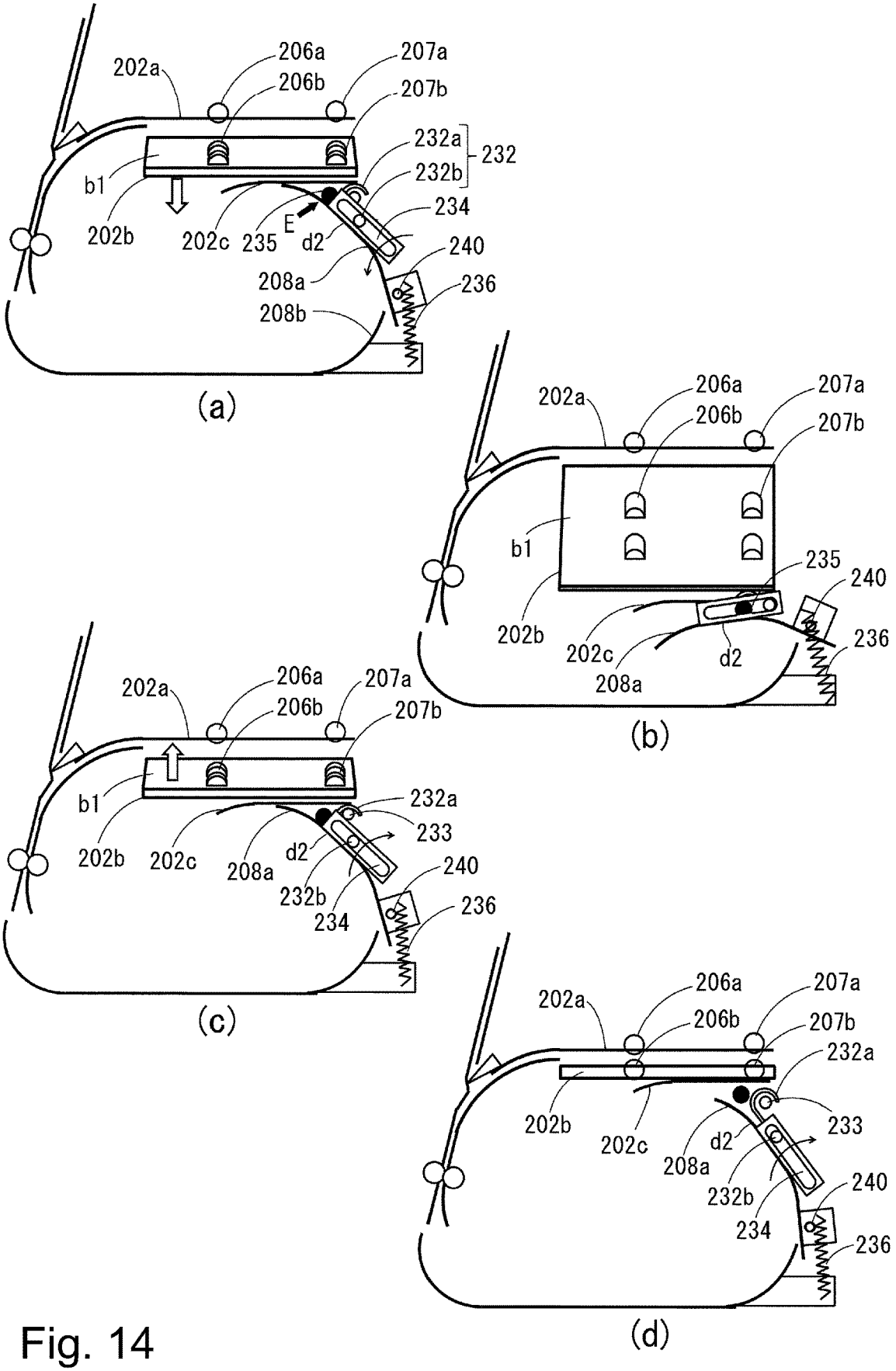

Parts (a) to (d) of FIG. 14 are schematic views for illustrating jam clearance in the reversing mechanism in the embodiment 4.

DESCRIPTION OF EMBODIMENTS

In the following, embodiments for carrying out the present invention will be described while making reference to the drawings.

(Image Forming Apparatus)

Figure 1:
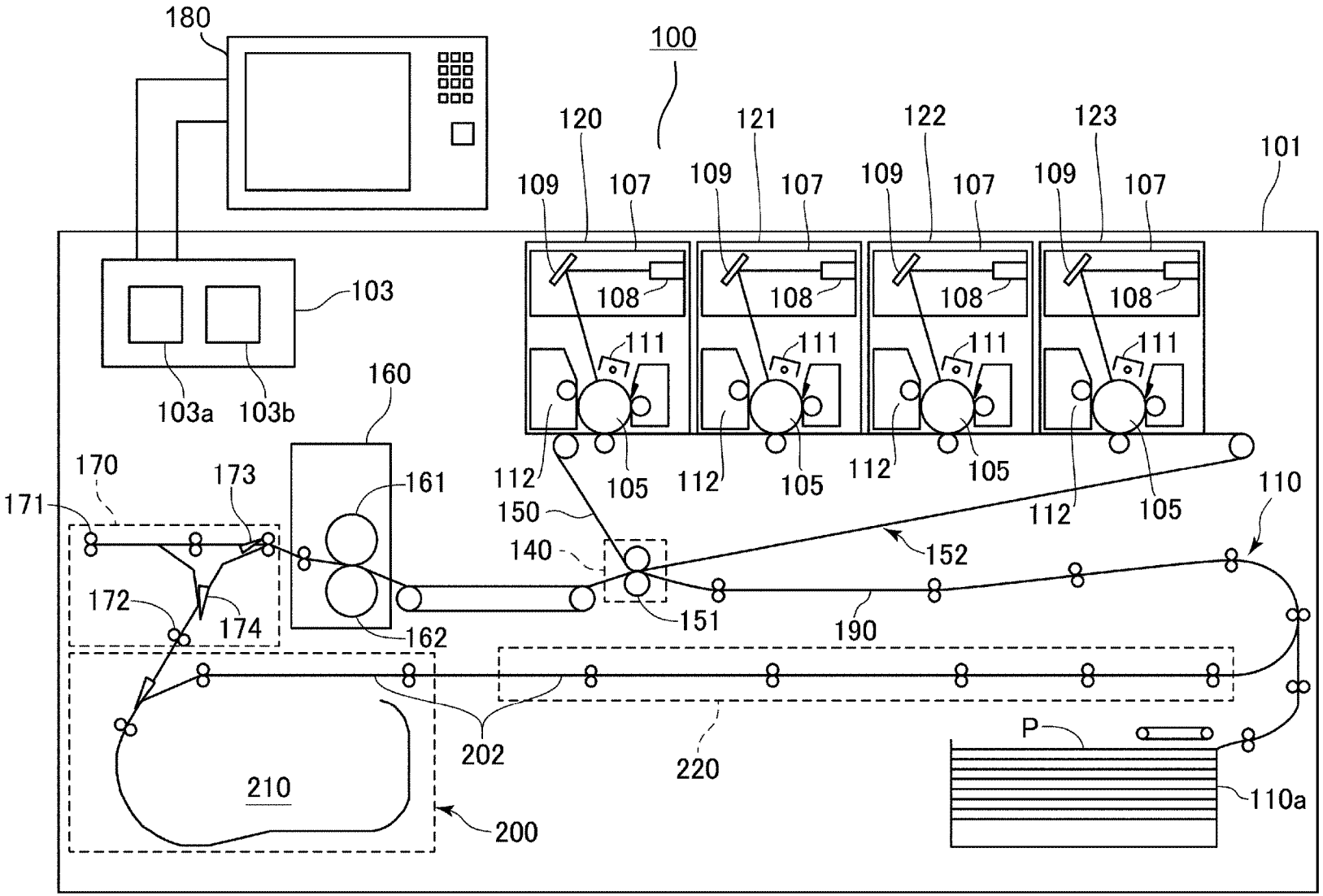
FIG. 1 is a schematic view of an image forming apparatus according to an embodiment of the present invention.

First, a structure of an image forming apparatus according to an embodiment of the present invention will be described. FIG. 1 is a sectional view showing a structure of a laser beam printer 100 which is the image forming apparatus in this embodiment. The printer 100 includes a casing 101 as an apparatus main assembly, and in the casing 101, mechanisms constituting an engine portion, an engine controller 103*a* and a control board accommodating portion 103 for accommodating a printer controller 103*b* are incorporated. The engine controller 103*a* controls an operation of the respective mechanisms constituting the engine portion. The printer controller 103*b* develops print data received from an external computer and carries out integrated control of the engine controller 103*a*, and thus executes a print job.

In this embodiment, the mechanisms constituting the engine portion refer to optical developing process mechanisms 120, 121, 122 and 123, an intermediary transfer mechanism 152, a secondary transfer portion 140, a fixing process mechanism 160, a feeding and conveying mechanism 110, a discharging mechanism 200 and a double-side feeding mechanism 220.

The optical developing process mechanisms 120, 121, 122 and 123 are stations each for forming a visible image (toner image of a single color by performing steps of charging, exposure and development in an electrophotographic process. The intermediary transfer mechanism 152 is a mechanism for forming a full-color toner image by primary-transferring the visible images formed by the optical developing process mechanisms 120, 121, 122 and 123 and by causing an intermediary transfer member 150 to carry the visible images. The secondary transfer portion 140 is a mechanism for secondary-transferring the toner images from the intermediary transfer member 150 onto a sheet P as a recording material. The fixing process mechanism 160 is a mechanism for fixing an image on the sheet P by subjecting the toner images, transferred on the sheet P, to a fixing process.

The feeding and conveying mechanism 110 is a mechanism for feeding and conveying the sheet p toward the secondary transfer portion. The discharging mechanism 170 is a mechanism for discharging the sheet P on which the image is formed by passing of the image through the secondary transfer portion 140 and the fixing process mechanism 160 and for dividing a feeding direction into different directions. The reversing mechanism 200 includes a reverse retracting portion 210 as a retracting portion where the sheet P is temporarily retracted when the sheet P is switched back, and is a mechanism for performing reverse feeding of the sheet P in the case of double-side printing. The double-side feeding mechanism 220 is a mechanism for feeding the sheet P, in a state in which the sheet P is reversed by the reversing mechanism 220, toward the secondary transfer portion 140 again.

A basis operation of the image forming apparatus will be described. A laser scanner portion 107 of each of the optical developing process mechanisms 120, 121, 122 and 123 includes a laser driver for ON/OFF-driving laser light emitted from an unshown semiconductor laser 108 depending on image data supplied from the printer controller 103*b*. The laser light emitted from the semiconductor laser 108 is used for scanning a photosensitive drum surface in a main scan direction by a rotatable polygonal mirror. The laser light changed in direction to the main scan direction is guided to a photosensitive drum 105 through a reflection polygonal mirror 109, so that the surface of the photosensitive drum 105 is exposed to the laser light in the main scan direction. On the other hand, an electrostatic latent image charged by a primary charger 111 and formed on the surface of the photosensitive drum 105 by the scanning exposure to the laser light as described above is visualized (developed) into a toner image by toner supplied by an associated developing device 112.

Thereafter, the toner image carried on the photosensitive drum 105 is primary-transferred, by applying a voltage of a polarity opposite to a charge polarity of the toner image, onto the intermediary transfer member 150 provided in the intermediary transfer mechanism 152. During color image formation, single-color toner images of yellow, magenta, cyan and black formed in the respective optical developing process mechanisms 120 to 123 are successively transferred onto the intermediary transfer member 150, so that a full-color visible image is formed on the surface of the intermediary transfer member 150.

The feeding and conveying mechanism 110 feeds the sheet P in parallel to the above-described image forming operation while separating the sheet P one by one from a sheet bundle accommodated in an accommodating portion 110*a* and conveys the sheet P to the secondary transfer portion 140. A path from the feeding and conveying mechanism 110 to the discharging mechanism 170 through the secondary transfer portion 140 and the fixing process mechanism 160 is a main feeding path 190 along which the image is formed on the sheet P.

Then, the visible images carried on the surface of the intermediary transfer member 150 are transferred (secondary-transferred) onto the sheet P, at the secondary transfer portion 140 constituted by a secondary transfer roller pair 151, fed by the feeding and conveying mechanism 110. The secondary transfer roller pair 151 causes the sheet P to press-contact the intermediary transfer member 150 and simultaneously carries out secondary transfer under application of a bias of a polarity opposite to the toner charge polarity.

The sheet P passed through the secondary transfer portion 140 is fed to the fixing process mechanism 160. The fixing process mechanism 160 includes a heating roller 161 and a pressing roller 162 which nip and feed the sheet P and includes a heat source (for example, a halogen lamp) for heating the toner image on the sheet P through the heating roller 161. The sheet P passes through a fixing nip constituted by the heating roller 161 and the pressing roller 162, so that the toner (image) transferred on the sheet P is heated and melted and thereafter is solidified, and thus an image fixed on the sheet P is obtained.

The sheet P passed through the fixing process mechanism 160 is fed to the discharging mechanism 170. In the discharging mechanism 170, a feeding path (feeding passage) of the sheet P is switched depending on whether or not the sheet P is subjected to the double-side printing. In the case of one-side printing, the sheet P is guided toward a discharging roller pair 171 by a first switching flap 173 and is discharged to an outside of the printer 100 by the discharging roller pair 171.

In the double-side printing, the sheet P on which the image is formed on the first surface is guided to a reverse entrance roller pair 172 by the first switching flap 173 and is fed toward the reversing mechanism 200 through the reverse entrance roller pair 172. The reversing mechanism 200 carries out the switch-back feeding and feeds the sheet P to the double-side feeding mechanism 220 while temporarily retracting the sheet P by using the reverse retracting portion 210.

The double-side feeding mechanism 220 merges with the feeding and conveying mechanism 110 on a side upstream of the secondary transfer portion 140 and feeds the sheet P, in a state in which the first surface and the second surface thereof are changed to each other by the reversing mechanism 200, to the feeding and conveying mechanism 110 again. In the reversing mechanism 200, a feeding path (an upstream feeding path 201 described later, FIG. 2) along which the sheet P before the switch-back is fed is a first feeding passage (feeding path) in this embodiment. A double-side feeding path 202 which is a path along which the sheet P switched back by the reversing mechanism 200 is fed again toward the main feeding path 190 in the reversing mechanism 200 and the double-side feeding mechanism 220 is a second feeding passage (feeding path). Then, the sheet P passes through the secondary transfer portion 140 and the fixing process mechanism 160 and thus the image is formed on the second surface, and thereafter, the sheet P is guided to the discharging roller pair 171 at this time and is discharged to the outside of the printer 100 by the discharging roller pair 171.

Incidentally, as the sheet p used as the recording material, it is possible to use various sheets such as general-purpose plain paper, recycled paper, coated paper (paper subjected to surface treatment such as resin (material) coating), thin paper and thick paper.

Further, in this embodiment, a long (elongated) sheet (for example, a sheet longer than 420 mm which is a long side of an A3-size sheet) longer than a general-purpose regular size in terms of a long with respect to the sheet feeding direction can be used as the recording material. Incidentally, the long sheet is not necessarily limited to be accommodated in the accommodating portion 110*a* shown in FIG. 1, but for example, the long sheet is set on a manual feeding tray projecting outward on a side of the casing 101 and then may also be supplied one by one to the feeding and conveying mechanism 110 by a feeding roller.

Further, the printer 100 is provided with an operating portion 180 which is a user interface. The operating portion 180 includes a display device such as a liquid crystal panel for displaying information to the user and an input device such as physical keys or a touch panel functional portion for the liquid crystal panel, through which the user is capable of inputting an instruction or data to the printer 100. The user operates the operating portion 180 and thus is capable of changing, for example, setting as to whether or not the sheet used in a present print job is the long sheet. The printer controller 103*b* executes the print job by controlling the engine controller 103*a* on the basis of information received from the operating portion 180.

The above-described tandem and intermediary transfer type electrophotographic mechanism (the optical developing process mechanisms 120, 121, 122 and 123, the intermediary transfer mechanism 152, the secondary transfer portion 140, and the fixing process mechanism 160) is an example of the image forming portion for forming the image on the sheet. When a technique described below is applied, for example, a direct transfer type electrophotographic mechanism in which the toner image formed on the photosensitive member is transferred onto the sheet without via the intermediary transfer member may also be used as the image forming portion. Further, the image forming portion is not limited to the electrophotographic mechanisms, and a printing unit of an ink jet type and an offset printing mechanism may also be used as the image forming portion.

(Reversing Mechanism)

Figure 2:
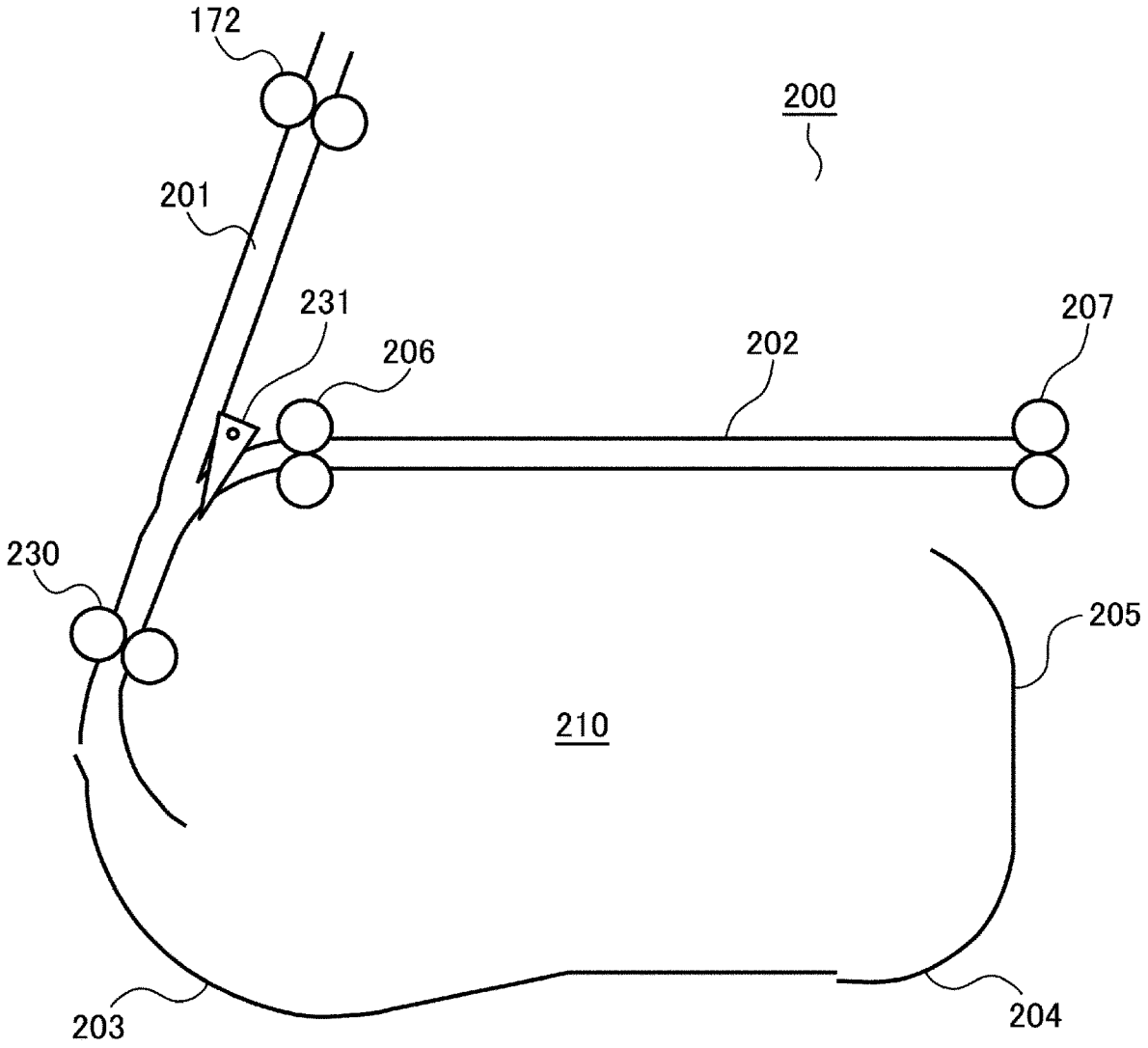
FIG. 2 is a schematic view of a reversing mechanism in the embodiment.

Next, the reversing mechanism 200 will be described. FIG. 2 is a schematic view when a periphery of the mechanism 200 is seen from a front side of the apparatus main assembly. The reversing mechanism 200 includes the upstream feeding path 201, a double-side feeding path 202, a reversing roller pair 230, a double-side switching flap 231, the reverse retracting portion 210 and double-side feeding roller pairs 206 and 207. The upstream feeding path 201 is a feeding passage through which the sheet guided to the reverse entrance roller pair 172 by the first switching flap 173 (FIG. 1) passes. The double-side feeding path 202 is a feeding passage through which the sheet reversed by the reversing roller pair 230 passes and communicates with a merged portion with the main feeding path 190 through the double-side feeding mechanism 220.

The reversing roller pair 230 is provided downstream (below with respect to the vertical direction) of a place where the upstream feeding path 201 and the double-side feeding path 202 merge with each other with respect to the feeding direction in the upstream feeding path 201. That is, the double-side feeding path 202 which is the second feeding passage in this embodiment branches from the upstream feeding path 201 which is the first feeding passage in this embodiment on a side upstream of the reversing roller pair 230 with respect to the feeding direction (first direction) before the reverse (reversing operation). The reversing roller pair 230 is drive-connected to a motor capable of normal rotation and reverse rotation, for example, so that the sheet feeding direction is capable of being switched. The double-side switching flap 231 is provided at the place where the upstream feeding path 201 and the double-side feeding path 201 merge with each other and restricts that the sheet reversed by the reversing roller pair 230 enters the upstream feeding path 201.

The double-side feeding path 203 is provided with the double-side feeding roller pairs 206 and 207. The double-side feeding roller pairs 206 and 207 which are the feeding portion in this embodiment feed the sheet, which is reversed by the reversing roller pair 230 and which is sent to the double-side feeding path 202, toward the double-side feeding mechanism 220 through the double-side feeding path 202.

The reverse retracting portion 210 is provided downstream of the reversing roller pair 230 with respect to the feeding direction in the upstream feeding path 201. The reverse retracting portion 210 forms a retracting region for temporarily retracting a part of the sheet when the reversing roller pair 230 switches back the sheet.

In this embodiment, as shown in FIG. 1, each of the main feeding path 190 and the double-side feeding path 202 extends in the substantially horizontal direction. Also in a range shown in FIG. 2, the double-side feeding path 202 extends from one side (left-hand side in the figure) toward the other side (right-hand side in the figure) in the horizontal direction. With respect to the vertical direction, the double-side feeding path 202 is provided below the main feeding path 190, and the reverse retracting portion 210 is provided below the double-side feeding path 202. In this embodiment, the fixing process mechanism 160 and the discharging mechanism 170 which are positioned above the reverse retracting portion 210 are in an arrangement relationship with the reverse retracting portion 210 such that each of the mechanisms 160 and 170 at least partially overlaps with the reverse retracting portion 210. Further, the reverse retracting portion 210 and the accommodating portion 110*a* are arranged in the horizontal direction and occupying ranges thereof with respect to the vertical direction overlap with each other. Such an arrangement is effective in suppressing upsizing of the printer 100 by disposing the reverse retracting portion 210.

Figure 3:
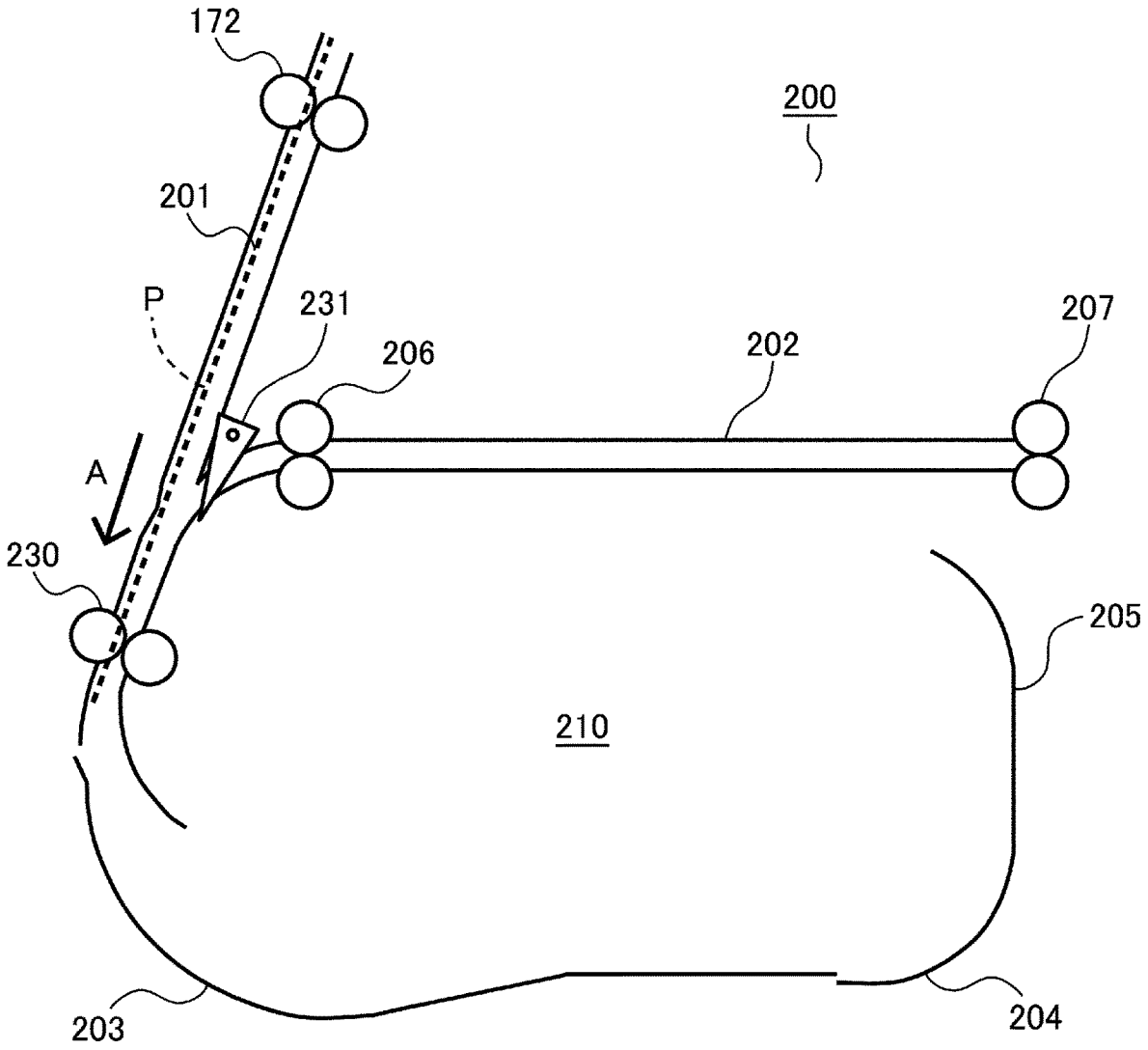
FIG. 3 is a schematic view for illustrating a reversing operation of a sheet by the reversing mechanism in the embodiment.
Figure 4:
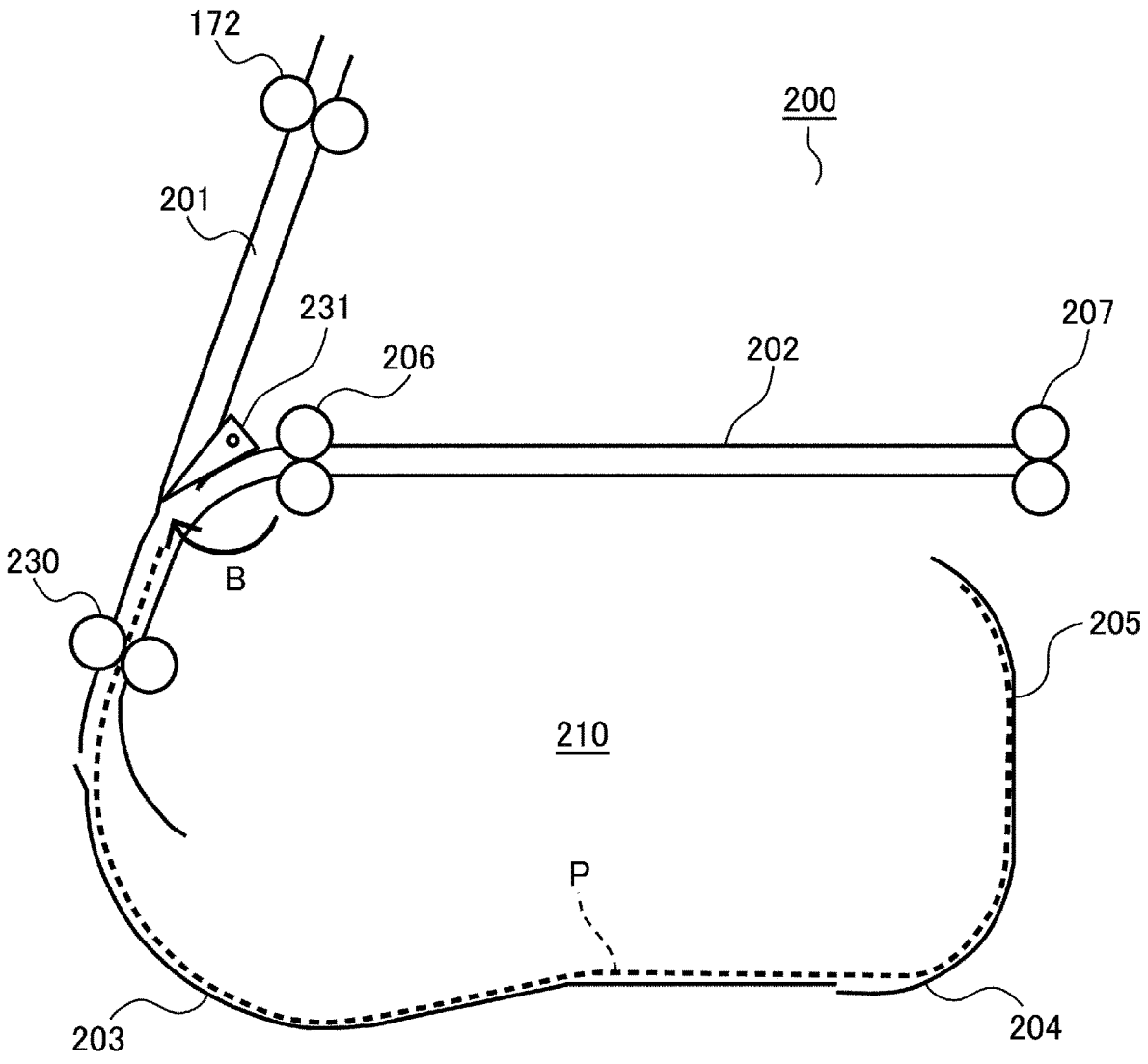
FIG. 4 is a schematic view for illustrating the reversing operation of the sheet by the reversing mechanism in the embodiment.
Figure 5:
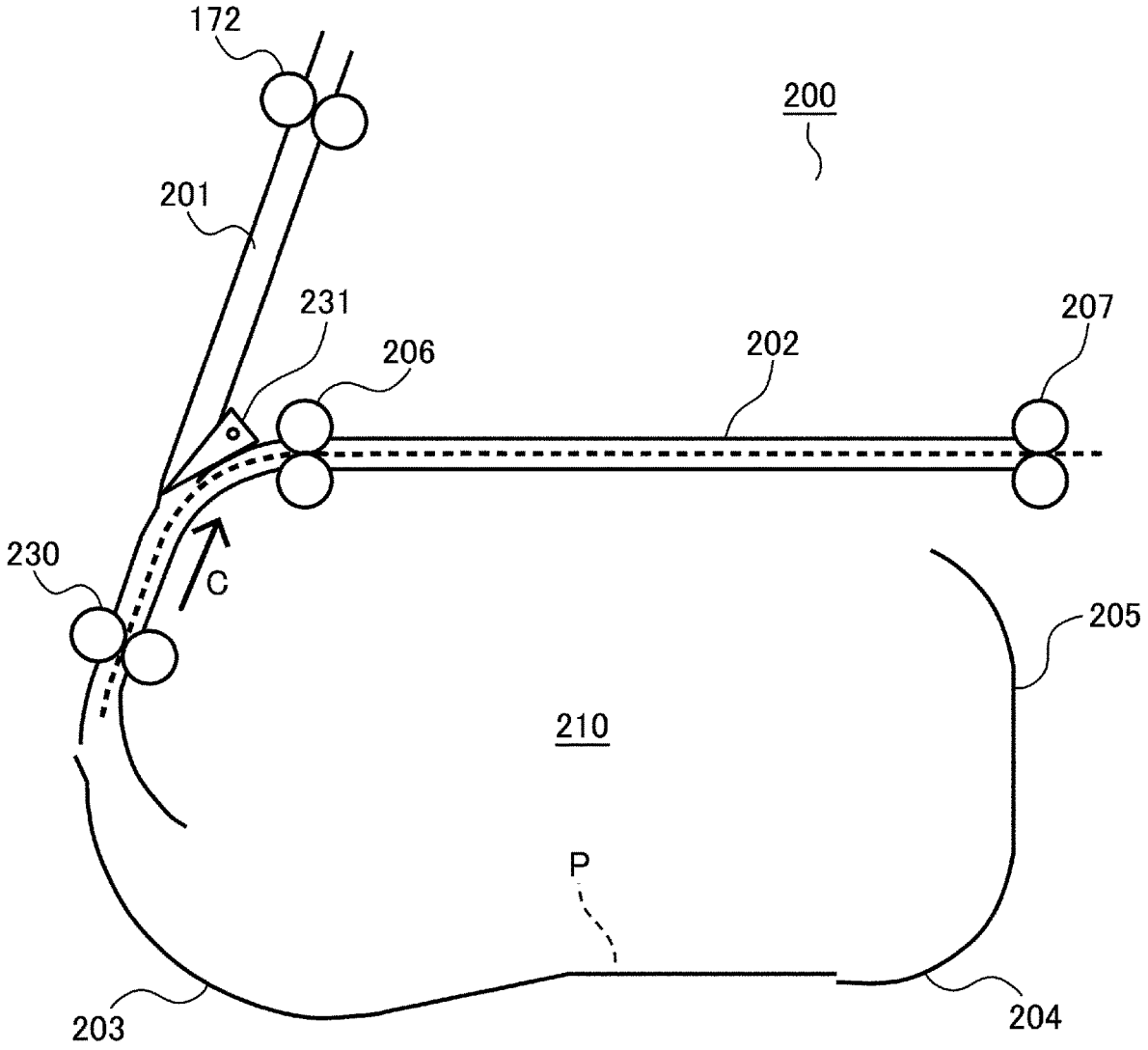
FIG. 5 is a schematic view for illustrating the reversing operation of the sheet by the reversing mechanism in the embodiment.

A basis operation of the sheet P in the reversing mechanism 200 will be described. FIGS. 3, 4 and 5 are schematic views showing the operation of the sheet P in the reversing mechanism 200.

The sheet P (broken line) fed from the reverse entrance roller pair 172 to the reversing mechanism 200 is fed along the upstream feeding path 201 and then is delivered to the reversing roller pair 230 (FIG. 3). The reversing roller pair 230 continues the feeding of the sheet P in a forward feeding direction A (first direction) when receives the sheet P from the reverse entrance roller pair 172. At this time, the sheet P fed from the reverse roller pair 230 in the forward feeding direction A is accommodated in the reverse retracting portion 210 and thus is in a shaft state.

When a trailing end of the sheet P with respect to the forward feeding direction A passes through the double-side switching flap 231, rotation of the reversing roller pair 230 stops temporarily. Thereafter, the double-side switching flap 231 is rotated in an arrow B direction, and a direction of thereof is changed so as to guide the sheet P to the double-side feeding path 202 by restricting that the sheet P enters the upstream feeding path 201 (FIG. 4). After the direction of the double-side switching flap 231 is changed, the reversing roller pair 230 changes the sheet feeding direction to a reverse feeding direction C (second direction) and feeds the sheet P. By this, the sheet P is fed to the double-side feeding path 202 and are conveyed by the double-side feeding roller pairs 206 and 207.

In the above, the case where the sheet reversed by the reversing mechanism 200 is fed along the double-side feeding path 202 was described, but the reversing mechanism 200 is also used in the case where face-down discharge of the sheet is carried out. The face-down double-side refers to an operation such that the sheet is discharged with the image-formed surface down in the case of the one-side printing. In the case of this embodiment, as shown in FIG. 1, a second switching flap 174 is provided on a side upstream of the reverse entrance roller pair 172, and in the case where the face-down discharge is carried out, the sheet reversed by the reversing mechanism 200 is guided to the discharging roller pair 171 by the second switching flap 174.

(Reverse Retracting Portion)

Figure 6:
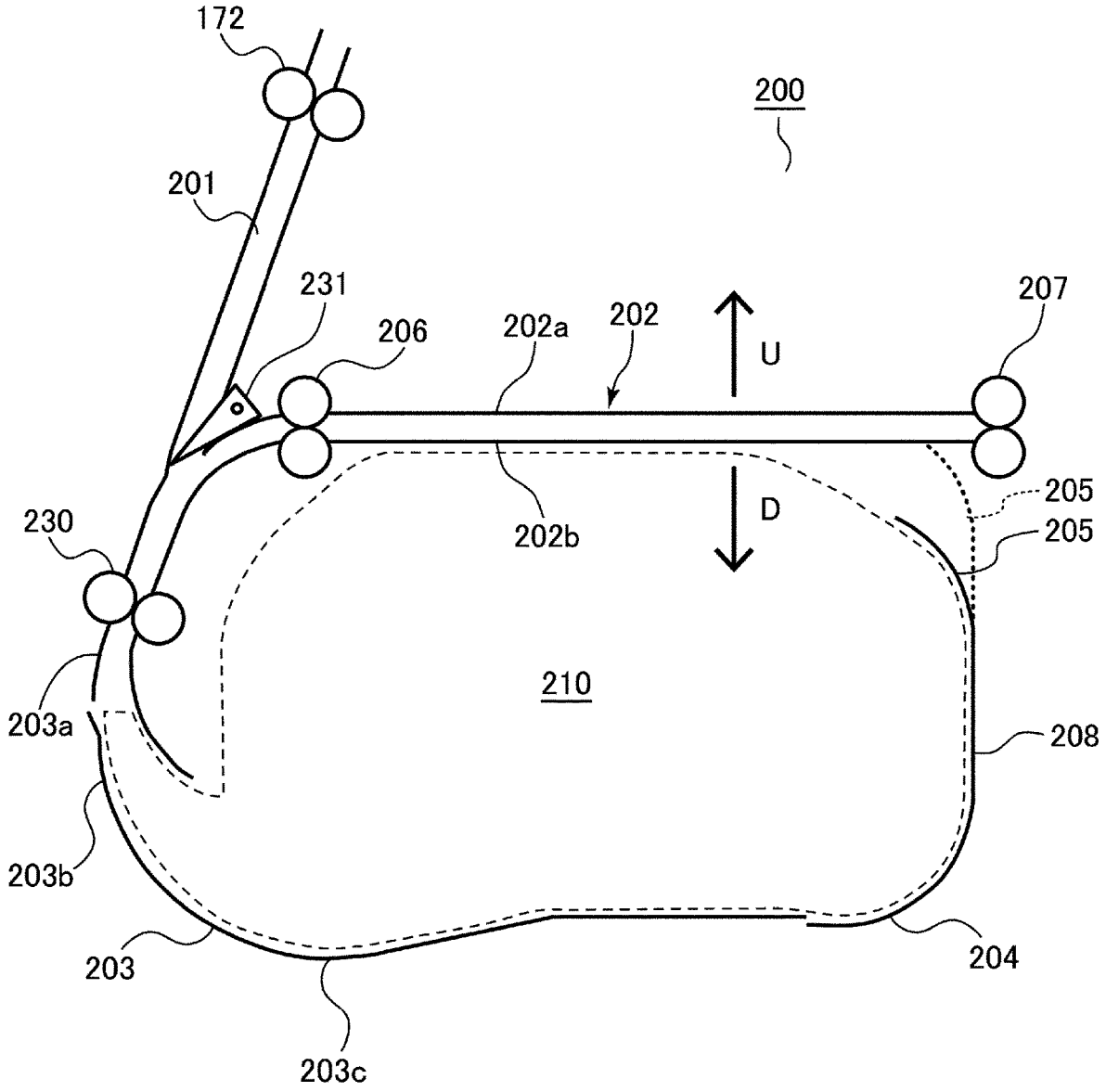
FIG. 6 is a schematic view for illustrating a reverse retracting portion in the embodiment.

Next, the reverse retracting portion 210 in this embodiment will be described. FIG. 6 is a schematic view when the reverse retracting portion 210 is seen from a front side of the apparatus main assembly.

The reverse retracting portion 210 is constituted by a guiding member provided so as to surround a retracting region (broken line) in which the sheet fed from the reversing roller pair 230 is retracted. The reverse retracting portion 210 is a feeding space including three bent portions consisting of a first bent portion 203, a second bent portion 204 and a third bent portion 205 in the order close to the reversing roller pair 230 with respect to the forward feeding direction A of the reversing roller pair 230. The first bent portion is constituted by feeding guides 203*a*, 203*b* and 203*c*, and the second bent portion 204 and the third bent portion 205 are constituted by a feeding guide 208.

A leading end of the sheet P fed from the reversing roller pair 230 to the reverse retracting portion 210 is guided while contacting these first bent portion 203, second bent portion 204 and third bent portion 205. Specifically, the leading end of the sheet P sent from the reversing roller pair 230 downward is guided by the first standing position 203 in the horizontal direction from an upstream side toward a downstream side with respect to the sheet feeding direction in the double-side feeding path 202. Then, the leading end of the sheet P is guided by the second bent portion 204 toward an upper side with respect to the vertical direction, and then is guided by the third bent portion 205 in a direction opposite to the sheet feeding direction in the double-side feeding path 202 with respect to the horizontal direction. Accordingly, when a relatively long sheet such as the long sheet (elongated sheet) is subjected to the switch-back by the reversing roller pair 230, the sheet is retracted inside the reverse retracting portion 210 in a state in which the sheet is curved along these bent portions. That is, the feeding guides 203*a*, 203*b*, 203*c* and 208 are curved surface guides in this embodiment constituting a guiding shape bent so that the sheet during the reverse (reversing operation) is retracted in a curved state. Incidentally, correspondence between physically separable guiding members and guide-shaped bent portions is not limited to that described as an example in this embodiment, but can also be appropriately changed.

Here, in the case where a longer sheet is intended to be retracted in the reverse retracting portion 210 without increasing an occupied space of the reverse retracting portion 210, a problem such that operativity of jam clearance in the double-side feeding path 202 becomes problematic will be described.

As shown in FIG. 6, above the reverse retracting portion 210, the double-side feeding path 202 is constituted by an upper surface guide 202*a* and a lower surface guide 202*b*. The upper surface guide 202*a* opposes an upper surface of the sheet passing through the double-side feeding path 202 from the double-side feeding roller pair 206 as a first roller pair toward the double-side feeding roller pair 207 as a second roller pair. The lower surface guide 202*b* opposes a lower surface of the sheet passing through the double-side feeding path 202 from the double-side feeding roller pair 206 toward the double-side feeding roller pair 207.

In the case where a sheet jam occurs and the jammed sheet is removed from the double-side feeding path 202, the double-side feeding path 202 is opened by moving one of the upper surface guide 202*a* and the lower surface guide 202*b* which constitute the double-side feeding path 202. However, above the double-side feeding path 202, a structure such as the fixing process mechanism 160 is disposed in many cases, so that there are many constraints on movement of the upper surface guide 202*a* upward (arrow U). For that reason, it is preferable that the double-side feeding path 202 is opened by moving the upper surface guide 202*b* downward (arrow D).

In this embodiment, the lower surface guide 202*b* is supported rotatably relative to a frame of the printer 100, so that the double-side feeding path 202 is openable by rotating the lower surface guide 202*b* downward (arrow D) from a state of FIG. 6. Incidentally, each of the feeding guides 203*a*, 203*b*, 203*c* and 208 is supported independently of the lower surface guide 202*b* relative to a frame of the image forming apparatus 1, so that even when the lower surface guide 202*b* is opened or closed, these feeding guides are not moved.

Incidentally, the lower surface guide 202*b* is movable downward from a position of a normal use (operation) state, while in order to retract the longer sheet in the reverse retracting portion 210, there is a need to utilize, as a retracting region, also a region close to the lower surface guide 202*b*. For example, when a sheet longer than the sheet P shown in FIG. 4 is intended to be retracted in the reverse retracting portion 210, in the structure shown in FIG. 4, a leading end portion of the sheet projects from the third bent portion 205. Therefore, in the case where the third bent portion 205 is moved upward in order to meet the long sheet without increasing a size of the reverse retracting portion 210 (in the case of the bent portion 205 indicated by a broken line in FIG. 6), there is a possibility that the bent portion 205 interferes with downward movement of the lower surface guide 202*b*.

As a method of avoiding such interference, for example, a constitution in which the third bent portion 205 is made movable and is moved simultaneously with the lower surface guide 202*b* in the case where the lower surface guide 202*b* is opened would be considered. However, in this constitution, by an increase in the number of the movable guiding members, the constitution becomes complicated and an operation of the jam clearance becomes complicated. As another method, it would be also considered that a range in which the lower surface guide 202*b* is made openable is narrowed so that the lower surface guide 202*b* does not interfere with the third bent portion 205, but with a narrower openable range, the case where it becomes difficult to remove the jammed sheet is liable to occur.

Therefore, in embodiments described below, the member constituting the lower surface guide 202*b* is integrally provided with a guiding surface for guiding the sheet retracted in the reverse retracting portion 210 as in the case of the third bent portion 205. By employing such a constitution, it becomes possible to easily remove the jammed sheet while meeting the long sheet.

Embodiment 1

Figure 7:
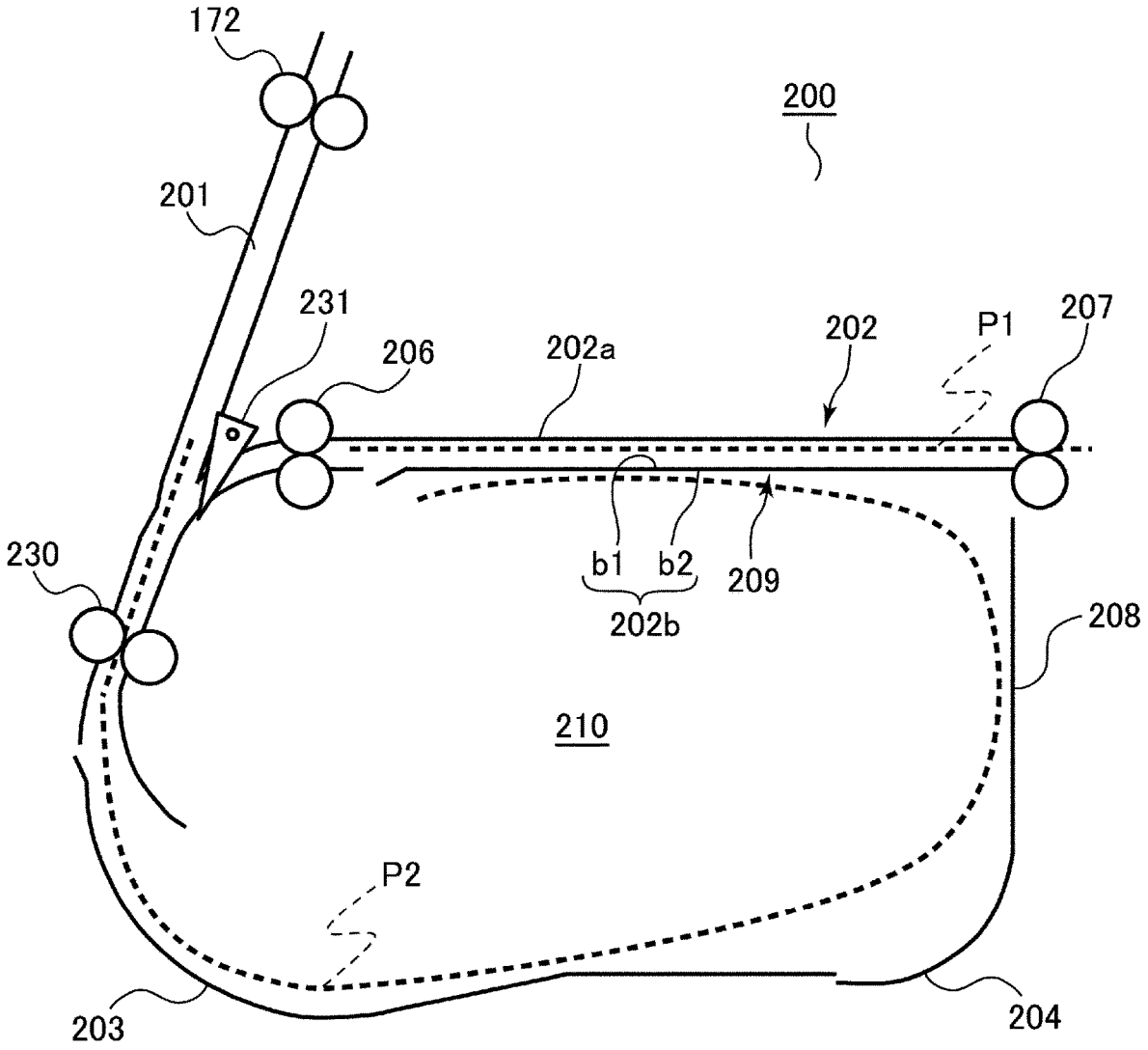
FIG. 7 is a schematic view of a reversing mechanism in an embodiment 1.
Figure 8:
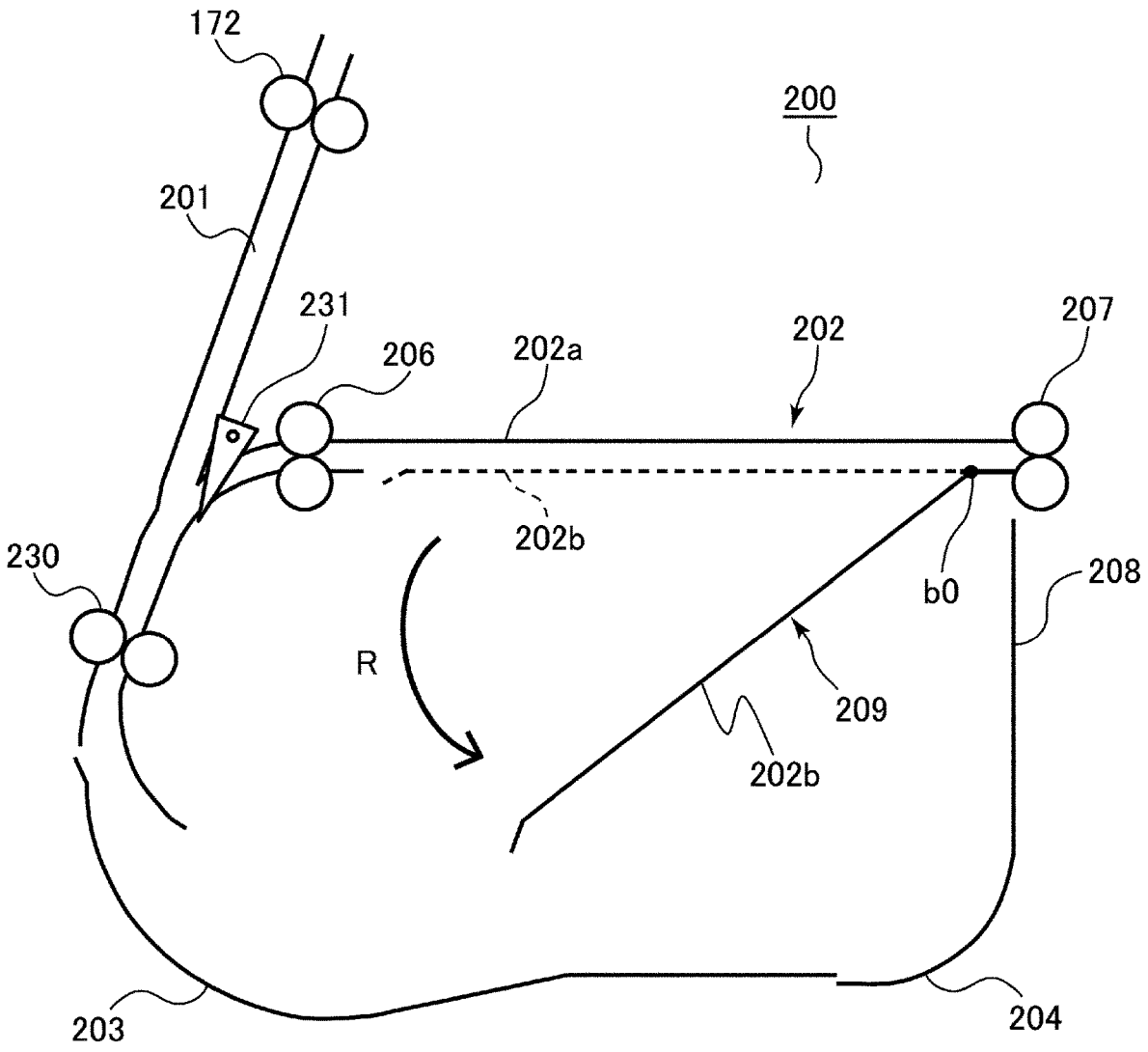
FIG. 8 is a schematic view for illustrating jam clearance in the reversing mechanism in the embodiment 1.

FIG. 7 is a schematic view of a reversing mechanism 200 in an embodiment 1, and FIG. 8 shows a state of jam clearance in a constitution of the embodiment 1. As shown in FIG. 7, a lower surface guide 202*b* in this embodiment includes, in addition to a front-side guiding surface b1 opposing the upper surface guide 202*a* and forming the double-side feeding path 202, a back-side guiding surface b2 opposing the retracting region defined by the reverse retracting portion 210. The front-side guiding surface b1 has a function of guiding a first surface (a lower surface of the sheet when the sheet passes through the double-side feeding path 202) of a sheet P1 passing through the double-side feeding path 202. On the other hand, the back-side guiding surface b2 has a function of guiding a second surface, opposite from the first surface, of a sheet P2 printed in the reverse retracting portion 210.

The front-side guiding surface b1 is a first guiding surface in this embodiment, and the back-side guiding surface b2 is a second guiding surface in this embodiment. That is, the lower surface guide 202*b* is a guiding member 209 in this embodiment constituted as a plate-like member including the first guiding surface on one side (surface) and the second guiding surface on the other side (surface). In this constitution, on the back-side (lower side) of the lower surface guide 202*b*, a function of guiding the sheet which extends toward a side (direction) opposite from the sheet feeding direction in the double-side feeding path 202 is imparted to the lower surface guide 202*b*. For that reason, in this embodiment, it is possible to omit the above-described third bent portion 205 (for example, FIG. 6).

Accordingly, in this embodiment, even when the lower surface guide 202*b* is rotated downward (arrow R) about a rotation shaft b0 shown in FIG. 8, for example, the lower surface guide 202*b* does not interfere with the third bent portion 205. By this, in a closed state of the lower surface guide 202*b*, it becomes possible to meet the long sheet by the back-side guiding surface b2, and on the other hand, the double-side feeding path 202 is opened by a simple operation such that the lower surface guide 202*b* is rotated downward and opened. Accordingly, by the constitution of this embodiment, it becomes possible to easily perform the jam clearance while meeting the long sheet.

Incidentally, the back-side guiding surface b2 has a function as a guiding surface for guiding a leading end of the sheet moving toward a left-hand side in FIG. 7, and therefore, a sheet contactable portion thereof is smoothly formed with respect to a movement direction (leftward direction in the figure) of the leading end of the sheet. For example, when entirety of the back-side guiding surface b2 is constituted by a smooth surface with respect to the movement direction of the sheet leading end and a widthwise direction of the sheet perpendicular thereto, the back-side guiding surface b2 is suitable as a guiding surface for guiding the sheet leading end. A sheet contactable portion constituted by a plurality of ribs extending along the movement direction of the sheet leading end is also suitable as the guiding surface for guiding the sheet leading end. Further, although it is not preferable that a projected shape such that the sheet leading end moving in the leftward direction in FIG. 7 is caught is positioned inside a region (maximum sheet width), with respect to the widthwise direction, through which the sheet is capable of passing, the presence of such a shape positioned outside the maximum sheet width does not obstacle the function as the guiding surface.

Further, the lower surface guide 202*b* in this embodiment was described as being rotated upward and downward about the rotation shaft b0 provided at an end portion on a side downstream of the guide with respect to the sheet feeding direction in the double-side feeding path 202, but a movement constitution of the guide is not limited thereto. For example, a constitution in which the lower surface guide 202*b* is rotated upward and downward about a rotation shaft provided at an end portion on a side upstream of the guide with respect to the sheet feeding direction in the double-side feeding path 202 may also be employed. Further, for example, a constitution in which the double-side feeding path 202 is opened by downward removing the lower surface guide 202*b* from the state of FIG. 7 may also be employed.

Further, the feeding guide 208 in this embodiment is not provided with the third bent portion 205, but may also be provided with the third bent portion 205 unless the third bent portion 205 interferes with the third bent portion 205 when the lower surface guide 202*b* is rotated to an angle of rotation necessary for the jam clearance.

Embodiment 2

Figure 9:
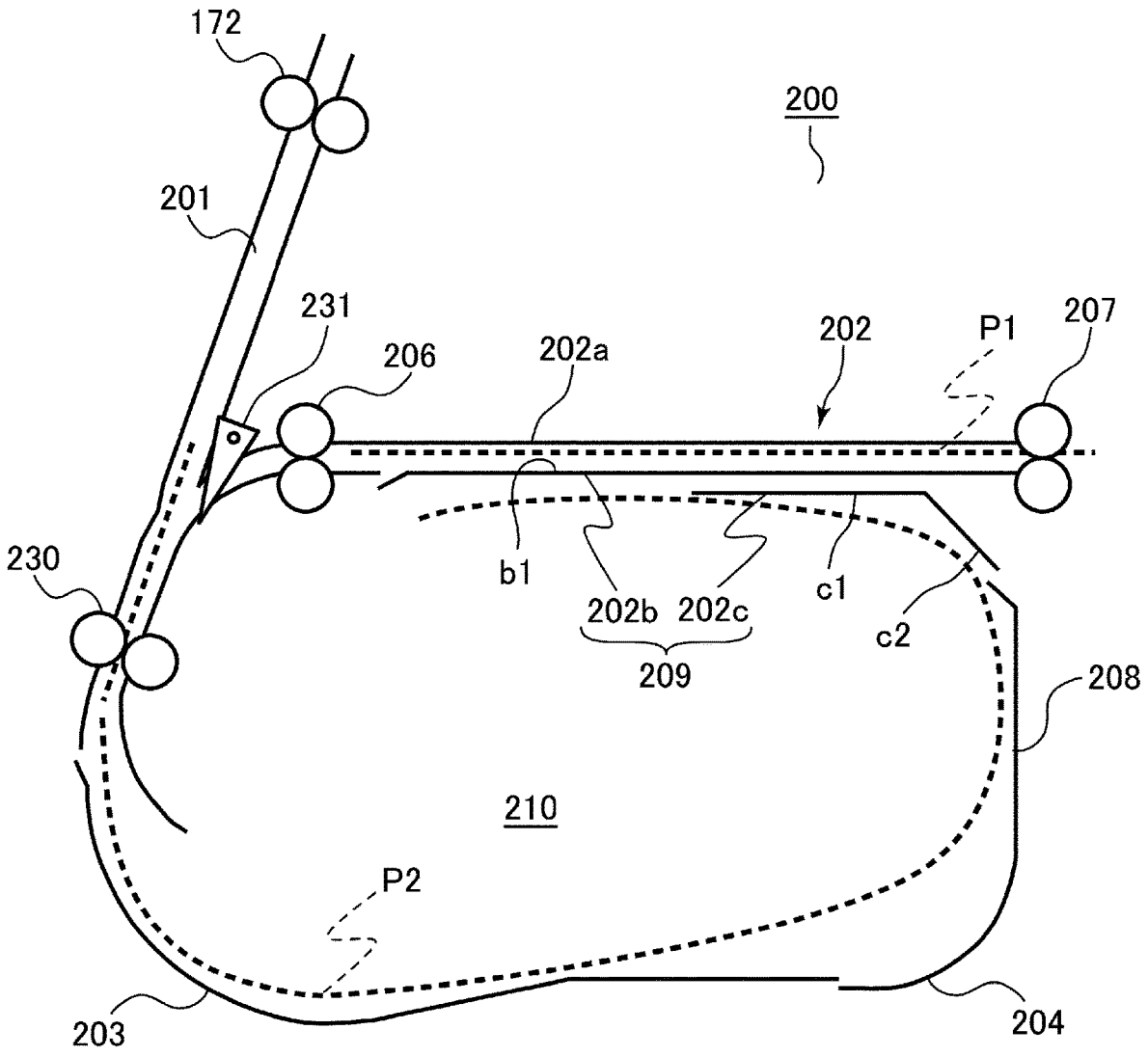
FIG. 9 is a schematic view of a reversing mechanism in an embodiment 2.
Figure 10:
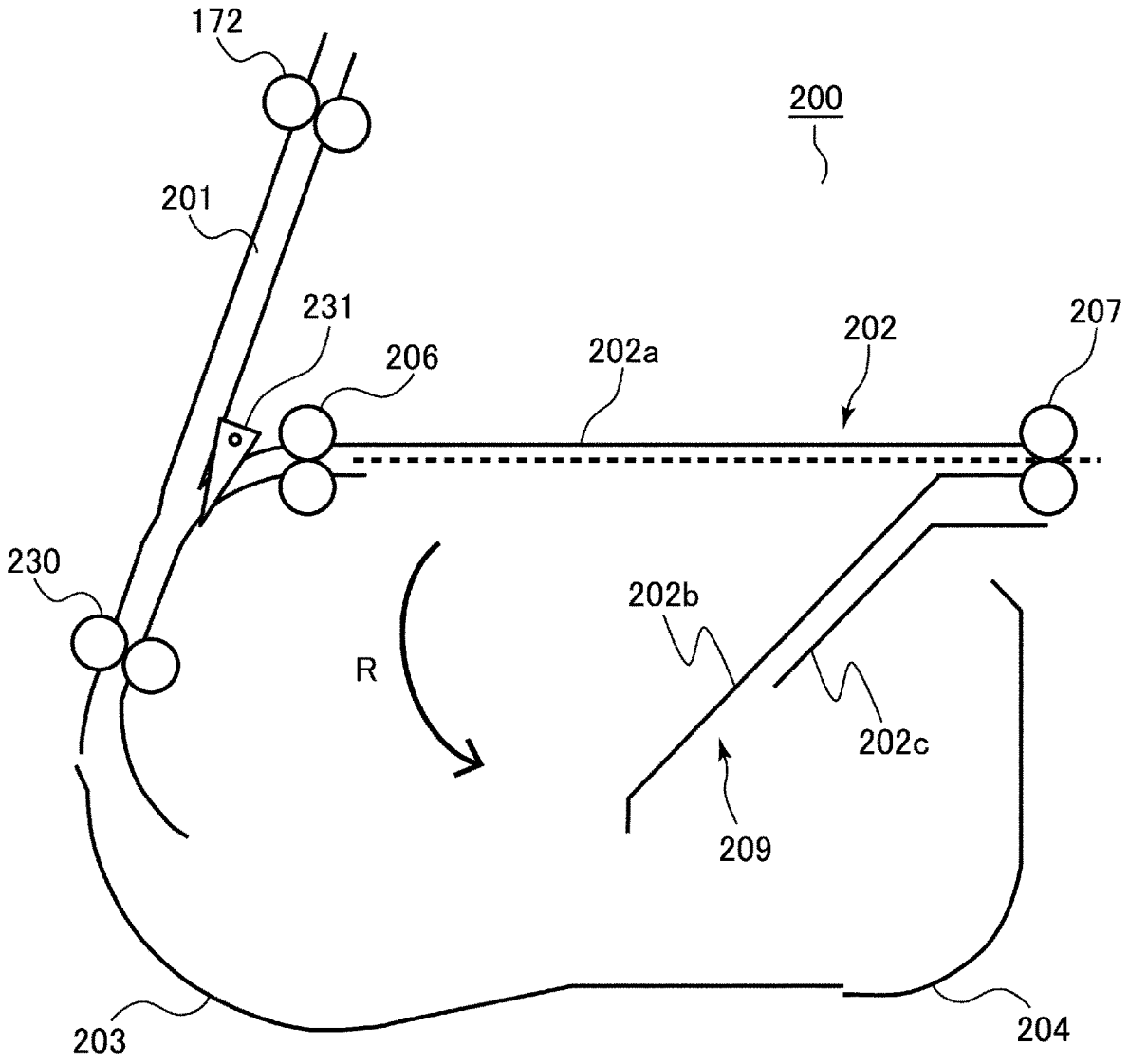
FIG. 10 is a schematic view for illustrating jam clearance in the reversing mechanism in the embodiment 2.

FIG. 9 is a schematic view of a reversing mechanism 200 in an embodiment 2, and FIG. 10 shows a state of jam clearance in a constitution of the embodiment 1. As shown in FIG. 9, similarly as in the embodiment 1, a lower surface guide 202*b* in this embodiment includes a front-side guiding surface b1 opposing the upper surface guide 202*a* and forming the double-side feeding path 202. Further, the lower surface guide 202*b* is supported rotatably by a frame of the printer 100, and is rotated downward from a position in a normal use state thereof shown in FIG. 9, so that the double-side feeding path 202 is opened.

Here, different from the embodiment 1, back-side guiding surfaces (c1, c2) as a second guiding surface opposing a retracting region formed by a reverse retracting portion 210 are provided on a lower guide 202*c* which is provided under the lower surface guide 202*b* as a separate plate-like member. The lower guide 202*c* is fixed to the lower surface guide 202*b* by an arbitrary method such as screwing or bonding. That is, a guiding member 209 in this embodiment is constituted by the lower surface guide 202*b* as a first guiding member and the lower guide 202*c* as a second guiding member fixed to the first guiding member.

As shown in FIG. 10, in the case where the jam clearance is carried out for the double-side feeding path 202, the guiding member 209 may only be required to be rotated downward (arrow R) about the rotation shaft b0. By this, the lower guide 202*c* for ordinarily guiding the sheet retracted in the reverse retracting portion 210 rotates together with the lower surface guide 202*b* of the double-side feeding path 202. That is, in a state in which the guiding member 209 is closed, it becomes possible to meet the long sheet by the back-side guiding surfaces (c1, c2) of the lower guide 202*c*, and on the other hand, it becomes possible to easily perform the jam clearance by a simple operation such that the guiding member 209 is opened downward.

Incidentally, as shown in FIG. 9, the back-side guiding surfaces of the lower guide 202*c* constituting the second guiding surface in this embodiment are constituted by a first region c1 and a second region c2 which are adjacent to each other. The first region c1 which is a first portion of the second guiding surface is positioned on a back-side of the front-side guiding surface b1 of the lower surface guide 202*b* as seen in the widthwise direction of the sheet and extends along the front-side guiding surface b1. The first region c1 guides a leading end of the sheet sent to the reverse retracting portion 210 in a direction opposite to the sheet feeding direction (rightward direction in the figure) in the double-side feeding path 202.

On the other hand, the second region c2 which is a second portion of the second guiding surface is positioned between the first region c1 and a bent feeding guide 208, and has a function of guiding the sheet while curving the sheet in cooperation with the bent feeding guide 208 constituting the reverse retracting portion 210. Specifically, the second region c2 is inclined relative to the first region c1 so that the second region c2 is more distant from the double-side feeding path 202 with respect to a thickness direction of the double-side feeding path 202 with a larger distance from a boundary between itself and the first region 1*c* (that is, toward a downstream side of the sheet feeding direction in the double-side feeding path 202). Thus, by imparting a function of curving the long sheet to be retracted to the lower guide 202*c* which is a part of the guiding member 209, it is possible to realize a smoother retracting operation.

Embodiment 3

Figure 11:
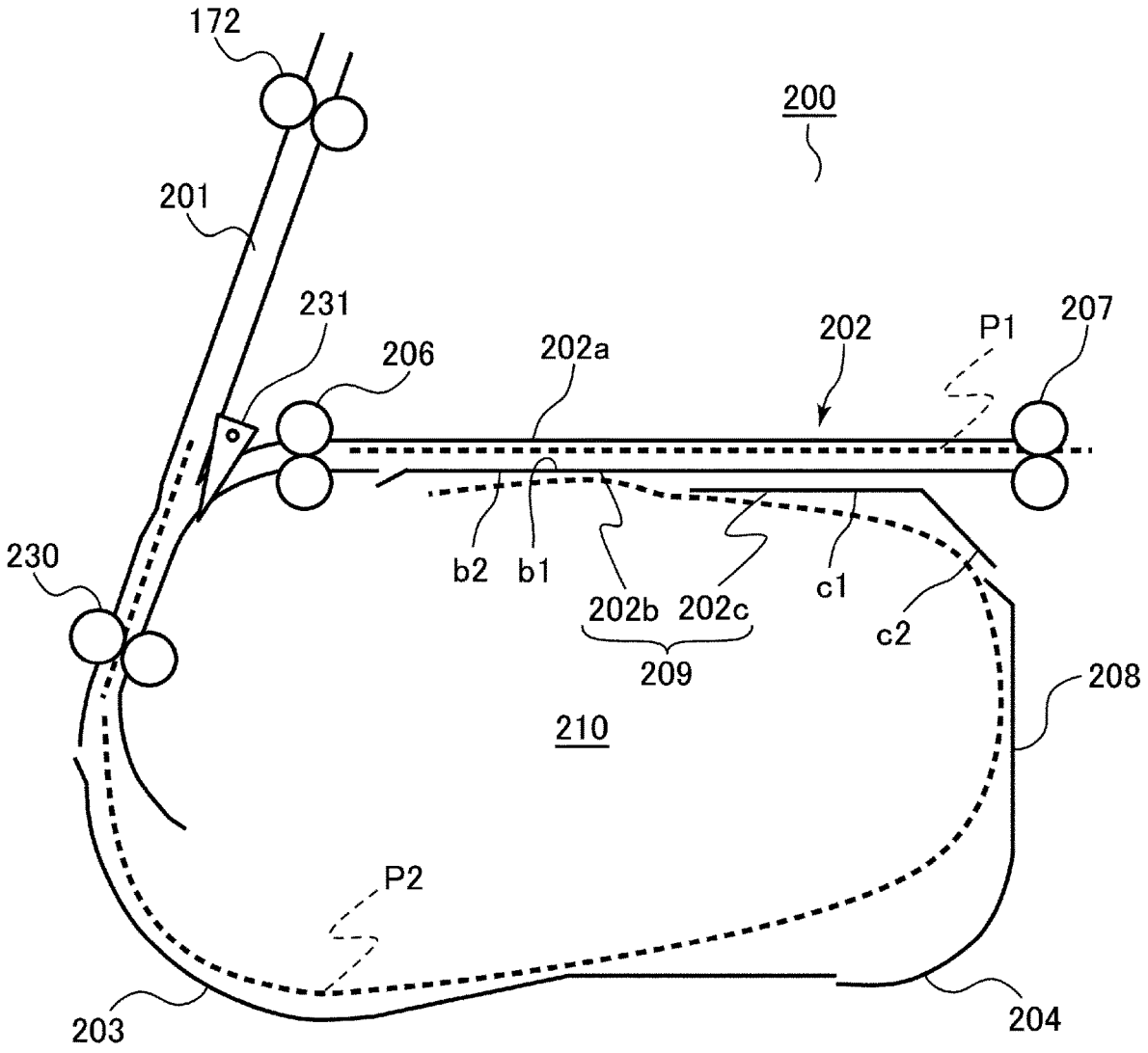
FIG. 11 is a schematic view of a reversing mechanism in an embodiment 3.

FIG. 11 is a schematic view of a reversing mechanism 200 in an embodiment 3. A guiding member 209 in this embodiment functions as a second guiding surface for guiding the sheet retracted in the reverse retracting portion 210 in cooperation with the guiding surfaces (c1, c2) of the lower guide 202*c*. That is, in the case where a long sheet longer than the long sheet in the embodiment 2 (FIG. 9) is retracted, a constitution in which the leading end of the long sheet is smoothly guided without being caught by the back-side of the lower surface guide 202*b* is employed.

In the case where the jam clearance is performed for the double-side feeding path 202, similarly as in the embodiment 2, the guiding member 209 may only be required to be rotated downward (arrow R) about the rotation shaft b0. By this, in a state in which the guiding member 209 is closed, it become possible to meet the long sheet, and on the other hand, it becomes possible to easily perform the jam clearance by a simple operation of opening the guiding member 209 downward.

Embodiment 4

As an embodiment 4, a constitution such that a movement direction of a first guiding member including a guiding surface for guiding the sheet fed along the double-side feeding path 202 and a second guiding member including a guiding surface for guiding the sheet in the reverse retracting portion 210 will be described.

Figure 12:
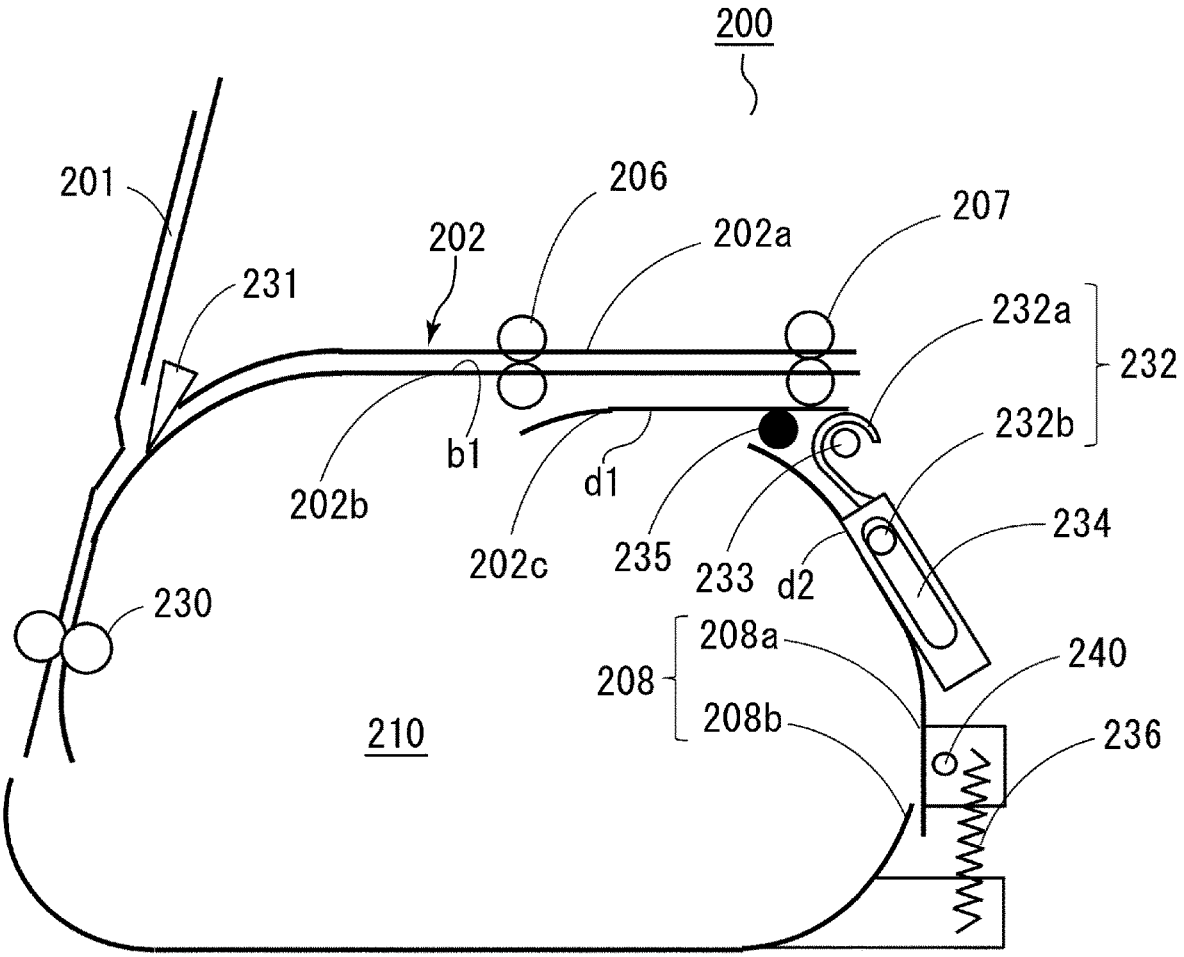
FIG. 12 is a schematic view of a reversing mechanism in an embodiment 4.
Figure 13:
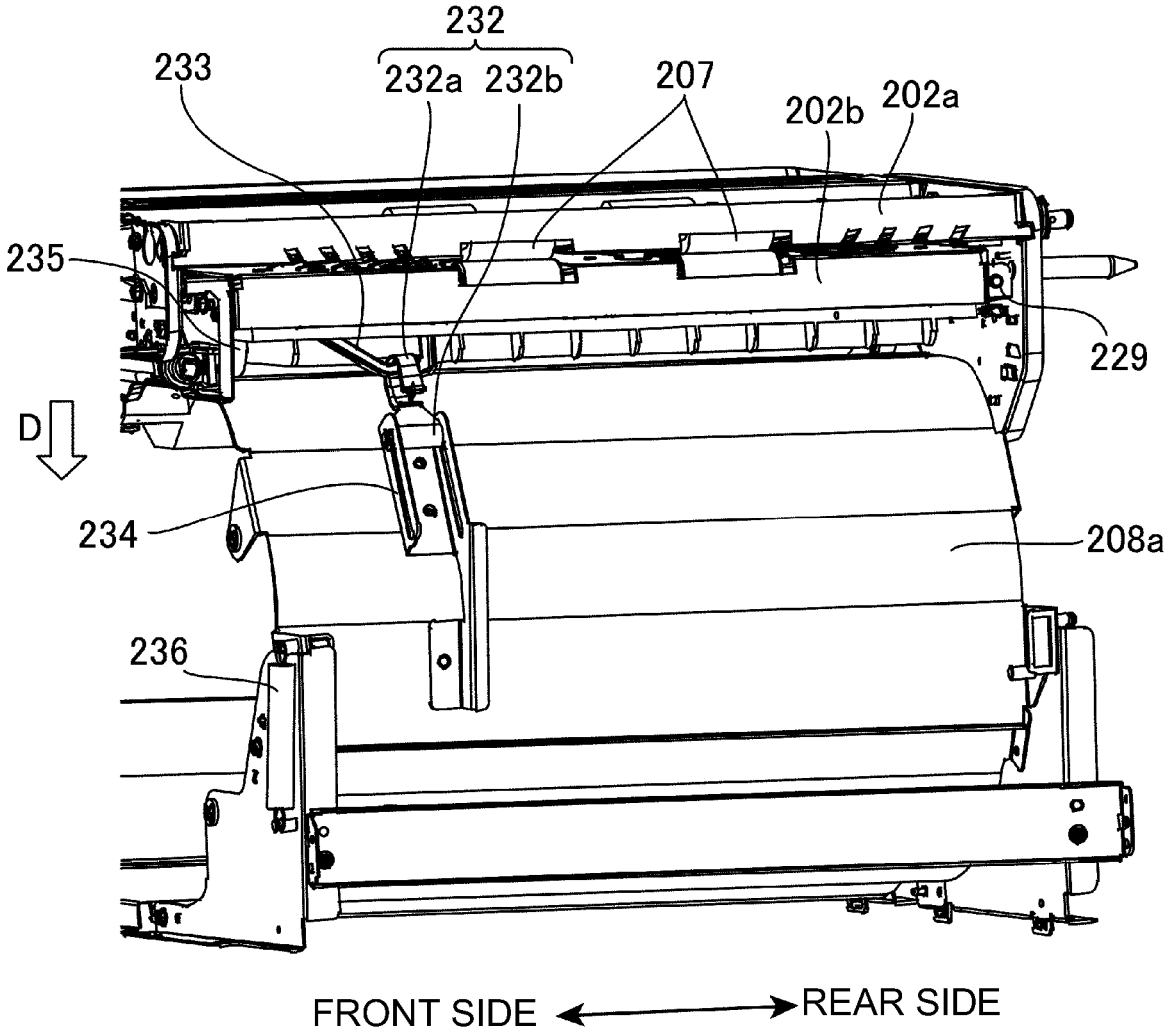
FIG. 13 is a perspective view of the reversing mechanism in the embodiment 4.

FIG. 12 is a schematic view of a reversing mechanism 200 in the embodiment 4. FIG. 13 is a perspective view of the reversing mechanism 200 in the embodiment 4 when the reversing mechanism 200 is seen from a right-hand side in FIG. 12. Parts (a) to (d) of FIG. 14 show states of the jam clearance in the constitution of the embodiment 4.

As shown in FIG. 12, similarly as in the embodiment 1, the lower surface guide 202*b* includes the front-side guiding surface b1 as the first guiding surface opposing the upper surface guide 202*a* and forming the double-side feeding path 202. Further, the lower guide 202*c* which a plate-like member separate from the lower surface guide 202*b* is also provided. The lower guide 202*c* is provided with a back-side guiding surface d1, for guiding the sheet sent to the reverse retracting portion 210, so as to overlap with at least a part of the front-side guiding surface b1. The lower surface guide 202*b* and the lower guide 202*c* are movably (rotatably) supported by the frame of the printer 100 and are rotated downward from positions thereof in normal use states shown in FIG. 12, so that the double-side feeding path 202 is opened.

Here, as shown in FIG. 13, this embodiment is different from the embodiment 2, and a rotation shaft 229 of the lower surface guide 202*b* and the lower guide 202*c* is provided on a rear side of the apparatus main assembly. That is, the lower surface guide 202*b* which is a first guiding member in this embodiment is rotatable about the rotation shaft 229 as a first shaft, and the rotation shaft 229 extends along the sheet feeding direction (the substantially horizontal direction in this embodiment) in the double-side feeding path 202. Incidentally, a front side of the printer 100 is one side with respect to a widthwise direction perpendicular to the sheet feeding direction by the reversing mechanism 200, and refers to a side where an openable door opened and closed relative to the apparatus main assembly (casing 101) by a user when the user performs the jam clearance, and the rear side is a side opposite from the front side.

Accordingly, when the double-side feeding path 202 is opened, the lower surface guide 202*b* and the lower guide 202*c* are rotated toward an arrow D direction shown in FIG. 13 so that the front sides of the lower surface guide 202*b* and the lower guide 202*c* are moved downward. By this, as shown in parts (a) and (b) of FIG. 14, the double-side feeding path 202 is opened. Thus, in this embodiment, it becomes possible to downward open substantial entirety of the lower surface guide 202*b* of the double-side feeding path 202 with respect to the sheet feeding direction. This has an advantage such that compared with other embodiments in which it is difficult to ensure an open space in the neighborhood of the rotation shaft due to the rotation about the rotation shaft extending in the widthwise direction of the sheet, the jam clearance can be easily performed by ensuring the open space of the double-side feeding path 202 in a broader range.

Further, in this embodiment, as to each of the double-side feeding roller pairs 206 and 207, one roller (upper-side roller 206*a*, 207*a*) of the roller pair is disposed on the apparatus main assembly side, and the other roller (lower-side roller 206*b*, 207*b*) of the roller pair is disposed on the lower surface guide 202*b* side. For this reason, when the lower surface guide 202*b* is rotated in the arrow D direction in order to open the double-side feeding path 202, the lower-side rollers 206*b* and 207*b* are moved downward away from the upper-side rollers 206*a* and 207*a*, so that it is possible to more easily perform the jam clearance. As shown in FIG. 12, when the lower surface guide 202*b* is closed, the lower-side rollers 206*b* and 207*b* contact the upper-side rollers 206*a* and 207*a*, so that nips for permitting nipping and feeding of the sheet by the double-side feeding roller pairs 206 and 207 are formed.

Incidentally, also in the constitutions of the above-described embodiments 1 to 3, as regards one or more double-side feeding roller pair, one roller of the roller pair may be disposed on the apparatus main assembly and the other roller may also be disposed on the lower surface guide 202*b* side (or on a member side where the member rotates integrally with the lower surface guide 202*b*).

(Movement of Feeding Guide 208)

Here, in order to more enlarge the above-described open space, in this embodiment, a constitution in which the feeding guide 208 positioned below the lower surface guide 202*b* and the lower guide 202*c* is movable is employed. As shown in FIG. 12, in a state in which the lower surface guide 202*b* is in a normal use position where the lower surface guide 202*b* forms the double-side feeding path 202, as seen in the vertical direction, in this embodiment, at least a part of the lower surface guide 202*b* and the lower guide 202*c* overlaps with the feeding guide 208. For that reason, in order to broaden the open space, it is effective to employ a constitution in which the feeding guide 208 can be retracted from movement loci (rotation loci in the case of this embodiment) of the lower surface guide 202*b* and the lower guide 202*c*.

The feeding guide 208 in this embodiment includes a rotation guide 208*a* movable (rotatable in this embodiment) relative to the apparatus main assembly of the printer 100 and a fixed guide 208*b* fixed to the apparatus main assembly. A guiding surface d2 of the rotation guide 208*a* functions as a second guiding surface, in this embodiment, for guiding the second surface of the sheet sent to the reverse retracting portion 210.

The rotation guide 208*a* is rotatable about a rotation shaft 240 extending in the widthwise direction of the sheet. The rotation shaft 240 is a second shaft extending in a direction crossing an axial direction of the rotation shaft 229 (FIG. 13) as the first shaft of the lower surface guide 202*b*, and the axial directions of the rotation shafts 229 and 240 are directions perpendicular to each other.

The rotation guide 208*a* is movable between a predetermined position (standing position) during normal use shown in FIG. 12 and a position (retracted position) lower than the standing position. That is, when the rotation guide 208*a* is in the standing position (FIG. 12), the guiding surface d2 of the rotation guide 208*a* extends to a position above the rotation shaft 240. When the rotation guide 208*a* is rotated from the standing position to the retracted position (part (b) of FIG. 14), a portion of the guiding surface d2 extending to the position above the rotation shaft 240 is moved downward, so that a maximum height of the rotation guide 208*a* lowers.

Accordingly, as shown in parts (a) and (b) of FIG. 14, when the lower surface guide 202*b* and the lower guide 202*c* are moved downward, the rotation guide 208*a* is rotated counterclockwise, so that the lower guide 202*c* can be lowered to a height close to a height of the rotation shaft 240. In other words, the rotation guide 208*a* is retracted from the standing position to the retracted position, an angle of rotation of the lower surface guide 202*b* as the first guiding member can be increased. For this reason, an open space between the lower surface guide 202*b* and the upper surface guide 202*a* is ensured more broadly, so that the jam clearance can be easily performed.

Incidentally, in a constitution in which the rotation guide 208*a* is operated independently of the lower surface guide 202*b* and the lower guide 202*c* in the case where the jammed sheet in the double-side feeding path 202 is removed, the user performs an operation of opening the guide two times. That is, in this case, from the normal use state, the user rotates the rotation guide 208*a* from the standing position to the retracted position and thereafter rotates the lower surface guide 202*b* and the lower guide 202*c* downward, so that the double-side feeding path 202 is opened.

On the other hand, in this embodiment, a constitution in which the rotation guide 208*a* is moved from the standing position to the retracted position in interrelation with an opening operation of the lower surface guide 202*b* and the lower guide 202*c* was employed. By such an interrelation operation, the user can move the function guide 208*a* simultaneously with the lower surface guide 202*b* and the lower guide 202*c* by a single operation of moving the lower surface guide 202*b* and the lower guide 202*c*. Further, as described later, a constitution in which the rotation guide 208*a* is restored from the retracted position to the standing position also in interrelation with a closing operation of the lower surface guide 202*b* and the lower guide 202*c* is employed. For this reason, it is possible to prevent the user from forgetting to return the position of the rotation guide 208*a* to the original position (standing position) at the time of an end of the jam clearance.

The constitution for interrelating the rotation guide 208*a* with opening and closing of the lower surface guide 202*b* and the lower guide 202*c* will be described.

As shown in FIGS. 12 and 13, the lower surface guide 202*b* is provided with a roller member 235 at a lower portion thereof. The roller member 235 is disposed so as to contact a back surface (surface opposite from the guiding surface d2) of the rotation guide 208*a* while rotating in the case where the lower surface guide 202*b* and the lower guide 202*c* are opened downward. The roller member 235 functions as a pressing portion for moving the second guiding member from the predetermined position by pressing the second guiding member with the operation of opening the first guiding member.

Further, the rotation guide 208*a* is provided with an engaging member 232. The engaging member 232 engages with a portion-to-be-engaged 233 provided integrally with the lower surface guide 202*b* and the lower guide 202*c* and thus connects the rotation guide 208*a* and the lower surface guide 202*b* so as to be movable relative to each other. That is, the engaging member 232 and the portion-to-be-engaged 233 function as a connecting portion for connecting the first guiding member and the second guiding member so as to be movable relative to each other.

The engaging member 232 in this embodiment employs a slider link. That is, the engaging member 232 is constituted by a slidable portion 232*b* engaging with an elongated hole of a link guide 234 fixed to the rotation guide 208*a* and a hooking portion 232*a* engaging with the portion-to-be-engaged 233. The slidable portion 232*b* is slidable along the elongated hole of the link guide 234. The hooking portion 232*a* is rotatable relative to the link guide 234 while maintaining a state in which the slidable portion 232*b* engages with the elongated hole of the link guide 234. The slidable portion 232*b* and the elongated hole of the link guide 234 have a function of absorbing a change in positional relationship between the rotation guide 208*a* and the guides (the lower surface guide 202*b* and the lower guide 202*c*), which rotate about the rotation shafts 229 and 240, respectively, which are different from each other.

The rotation guide 208*a* is provided with an urging spring 236 as an urging portion. The urging spring 236 is a tensile spring connecting the rotation guide 208*a* and the frame of the apparatus main assembly, and urges the rotation guide 208*a* so as to hold the rotation guide 208*a* at the standing position.

A specific operation of the rotation guide 208*a* when the double-side feeding path 202 is opened and closed will be described using parts (a) to (d) of FIG. 14. Part (a) of FIG. 14 shows a state in which opening of the double-side feeding path 202 is started, and part (b) of FIG. 14 shows a state in which the double-side feeding path 202 is most opened (open state). Part (c) of FIG. 14 shows a state during closing of the double-side feeding path 202 from the open state, and part (d) of FIG. 14 shows a state immediately before the double-side feeding path 202 is closed.

As shown in part (a) of FIG. 14, when the lower surface guide 202*b* and the lower guide 202*c* are rotated downward in order to open the double-side feeding path 202, the roller member 235 contacts the rotation guide 208*a* at a position of an arrow E and thus presses down the rotation guide 208*a*. By this, the rotation guide 208*a* is rotated about the rotation shaft 240 counterclockwise as shown in the figure and is moved to the retracted position, and thus is put in a state shown in part (b) of FIG. 14. That is, also in this embodiment, the guiding surface d2 as the second guiding surface of the rotation guide 208*a* moves with movement of the first guiding surface (front-side guiding surface b1 of the lower surface guide 202*b*) for opening the double-side feeding path 202.

In the case where the double-side feeding path 202 is closed from the open state of part (b) of FIG. 14, with raising of the lower surface guide 202*b*, the rotation guide 208*a* is raised through engagement between the portion-to-be-engaged 233 and the hooking portion 232*a*. By this, as shown in part (c) of FIG. 14, the rotation guide 208*a* is rotated in the clockwise direction in the figure from the retracted position toward the standing position. During this rotation, the slidable portion 232*b* slides along the elongated hole of the link guide 234, so that the engaging member 232 transmits a force for raising the rotation guide 208*a* while absorbing the change in relative position between the lower surface guide 202*b* and the rotation guide 208*a*. By this, with movement of the first guiding surface for closing the double-side feeding path 202, the guiding surface d2 as the second guiding surface of the rotation guide 208*a* smoothly moves.

As shown in part (d) of FIG. 14, when the state of the double-side feeding path 202 approaches the closed state, the rotation guide 208*a* is urged toward the standing position which is the position during the normal use by the urging force of the urging spring 236. That is, the rotation guide 208*a* is rotated by being pulled by the lower surface guide 202*b* until during the closing operation of closing the double-side feeding path 202. By this, immediately before the double-side feeding path 202 is closed, by the urging force of the urging spring 236, the rotation guide 208*a* automatically returns to the standing position irrespective of the force from the lower surface guide 202*b* and is held at the standing position even after the double-side feeding path 202 is closed (FIG. 12).

Further, the urging spring 236 employs a constitution in which the urging force changes depending on the position of the rotation guide 208*a*. That is, in a state in which the rotation guide 208*a* is in the standing position shown in FIG. 12 or in a position close to the standing position, by a resilient force of the urging spring 236, moment in a direction (clockwise direction in the figure) toward the standing position with the rotation shaft 240 as a center acts on the rotation guide 208*a*.

On the other hand, as the rotation guide 208*a* is rotated from the standing position toward the retracted position, by a self-weight of the rotation guide 208*a*, moment, in a direction (counterclockwise direction in the figure) toward the retracted position, acting on the rotation guide 208*a* becomes large. As the rotation guide 208*a* rotates from the standing position toward the retracted position, by the resilient force of the urging spring 236, a magnitude of the movement, in the clockwise direction in the figure, acting on the rotation guide 208*a* becomes small. For this reason, a constitution in which when the rotation guide 208*a* rotates from the standing position (predetermined position) toward the retracted position, the moment by the self-weight and the moment by the urging spring 236 are canceled each other is employed.

Thus, by employing a constitution in which in a state in which the rotation guide 208*a* rotates from the standing position by a predetermined angle or more, a force for raising the rotation guide 208*a* by the urging spring 236 and the self-weight of a rotation passage are canceled each other, the following advantages are obtained. First, when the double-side feeding path 202 is closed while being raised, the self-weight of the rotation guide 208*a* does not readily act on the engaging member 232 and the portion-to-be-engaged 233, and therefore, it is possible to reduce a risk such that the slidable portion 232*b* becomes immovable in the elongated hole of the link guide 234 due to a twist therebetween. Further, in the operation of raising the rotation guide 208*a*, the self-weight of the rotation guide 208*a* does not readily act, and therefore, it becomes possible to reduce an operation load of the user when the user closes the lower surface guide 202*b* while interrelating the rotation guide 208*a* with the lower surface guide 202*b*.

For example, a constitution (toggle constitution) in which a place where the direction of the moment (the sum of the moment by the self-weight and the moment by the urging spring 236) acting on the rotation guide 208*a* exists within a rotation range of the rotation guide 208*a* from the standing position to the retracted position may also be employed. Specifically, it is preferable that a state in which the moment by the self-weight and the moment by the urging spring 236 are approximately balanced with each other is formed in a state in which the rotation guide 208*a* is rotated from the standing position with an angle of 10° to 30° or of more than 30°.

Here, the state in which the moment by the self-weight and the moment by the urging spring 236 are approximately balanced with each other refers to that the magnitude of the moment acting on the rotation guide 208*a* is sufficiently smaller than the magnitude of the moment in the case where the rotation guide 208*a* is in the standing position. For example, the magnitude of the moment, in the clockwise direction or the counterclockwise direction in part (b) of FIG. 14, acting on the rotation guide 208*a* in a state of part (b) of FIG. 14 in which the double-side feeding path 202 is opened to the maximum may preferably be ½ or less, more preferably be ¼ or less, of the moment acting on the rotation guide 208*a* in the state of FIG. 12.

Modified Embodiments

Incidentally, in the above-described embodiment, description was made that the rotation guide 208*a* is moved in interrelation with either of the operation of opening the double-side feeding path 202 and the operation of closing the double-side feeding path 202, but for example, the rotation guide 208*a* may also be moved in interrelation with only the opening operation of the double-side feeding path 202. Further, for example, a constitution in which the rotation guide 208*a* is operated independently of the opening and the closing of the double-side feeding path 202 is employed, so that a simple constitution such that an interrelation mechanism of the rotation guide 208*a* is omitted may also be used.

Further, for example, the engaging member 232 and the portion-to-be-engaged 233 are omitted, and the rotation guide 208*a* can also be moved in interrelation with the opening and the closing of the double-side feeding path 202 by the roller member 235 and the urging spring 236. In that case, the urging spring 236 is provided so as to urge the rotation guide 208*a* toward the standing position which overcoming the self-weight thereof in an entire region of the rotation range of the rotation guide 208*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2019-130430 filed on Jul. 12, 2019 and 2020-052460 filed on Mar. 24, 2020, which are hereby incorporated by reference herein in their entirety.

What is claimed is:

1. An image forming apparatus comprising:

an image forming portion configured to form an image on a sheet;

a reversing portion configured to reverse the sheet, on which the image is formed by the image forming portion and which is received through a first feeding passage, by feeding the sheet in a first direction and then by feeding the sheet in a second direction opposite to the first direction;

a feeding portion provided in a second feeding passage branching from the first feeding passage on a side upstream of the reversing portion with respect to the first direction and configured to feed the sheet, reversed by the reversing portion, toward the image forming portion through the second feeding passage;

a first guiding surface forming the second feeding passage and configured to guide a first surface of the sheet fed by the feeding portion in the second direction; and a second guiding surface configured to guide a second surface, opposite from the first surface, of the sheet fed from the reversing portion in the first direction, wherein the second guiding surface is movable together with the first guiding surface when the second feeding passage is opened, and wherein, with respect to a thickness direction of the sheet opposing the second guiding surface, the first guiding surface and the second guiding surface are positioned between the second feeding passage and a reversing passage, and wherein the reversing passage is a sheet passage through which a portion of the sheet fed from the reversing portion in the first direction passes when the reversing portion reverses the sheet.

2. An image forming apparatus according to claim 1, wherein as seen in the thickness direction of the sheet, the first guiding surface and the second guiding surface overlap with each other.

3. An image forming apparatus according to claim 1, further comprising a curved surface guide that is bent so that a portion of the sheet fed from the reversing portion in the first direction is put into a curved state as seen in a widthwise direction of the sheet perpendicular to the first direction, and wherein the second guiding surface opposes an outside surface of the surface of the sheet curved by the curved surface guide.

4. An image forming apparatus according to claim 3, wherein the second feeding passage extends from one side to the other side with respect to a horizontal direction at a portion below the image forming portion, and the reversing passage is provided below the second feeding passage, wherein the curved surface guide includes a first bent portion configured to guide a leading end of the sheet, fed from the reversing portion toward a lower side with respect to a vertical direction, toward the other side with respect to the horizontal direction and includes a second bent portion configured to guide the leading end of the sheet, guided by the first bent portion, toward an upper side with respect to the vertical direction, and wherein the second guiding surface guides the leading end of the sheet, guided by the second bent portion, toward the one side with respect to the horizontal direction.

5. An image forming apparatus according to claim 3, wherein the second guiding surface includes a first portion extending along the first guiding surface as seen in the widthwise direction and a second portion positioned between the first portion and the curved surface guide, and wherein second portion opposes the outside surface of the sheet curved by the curved surface guide and is inclined so that the leading end of the sheet is guided toward the first portion while the sheet is curved in the same direction as curvature formed by the curved surface guide.

6. An image forming apparatus according to claim 1, wherein the reversing passage is provided below the second feeding passage, wherein the first guiding surface opposes a lower side surface of the sheet passing through the second feeding passage, and wherein the second feeding passage is opened by rotation of the first guiding surface toward a lower side with respect to the vertical direction from a state in which the first guiding surface forms the second feeding passage.

7. An image forming apparatus according to claim 1, further comprising a guiding member provided with the first guiding surface and the second guiding surface and movable integrally with a main assembly of the image forming apparatus.

8. An image forming apparatus according to claim 1, further comprising:

a movable first guiding member provided with the first guiding surface, and a movable second guiding member provided with the second guiding surface and movable relative to the first guiding member, wherein the second guiding member is movable together with the first guiding member when the second feeding passage is opened.

9. An image forming apparatus according to claim 8, wherein the first guiding member rotates about a first shaft extending in a direction along a sheet feeding direction in the second feeding passage, and wherein the second guiding member rotates about a second shaft extending in a direction crossing an axial direction of the first shaft.

10. An image forming apparatus according to claim 8, further comprising an urging portion configured to urge the second guiding member toward a predetermined position where the second surface of the sheet is guided, wherein, when the first guiding member moves from a state in which the second feeding passage is opened toward a position where the first guiding member forms the second feeding passage, the second guiding member is moved to the predetermined position by an urging force of the urging portion.

11. An image forming apparatus according to claim 8, further comprising a pressing portion provided on the first guiding member and configured to retract the second guiding member from a movement locus of the first guiding member by pressing the second guiding member with movement of the first guiding member for opening the second feeding passage.

12. An image forming apparatus according to claim 1, wherein the feeding portion includes a first roller pair configured to receive and feed the sheet fed from the reversing portion in the second direction and includes a second roller pair configured to receive and feed the sheet from the first roller pair, and wherein the first guiding surface guides the sheet between the first roller pair and the second roller pair.

* * * * *